US005680948A

United States Patent [19]

Schmidt et al.

[11] Patent Number: 5,680,948

[45] Date of Patent: Oct. 28, 1997

[54] RECEPTACLE HAVING A COLLAPSIBLE SIDEWALL STRUCTURE

[75] Inventors: Lothar Schmidt, Wolfsburg; Michael W. Luib, Donaueschingen, both of Germany

[73] Assignee: Volkswagen AG, Wolfsburg, Germany

[21] Appl. No.: 329,439

[22] Filed: Oct. 26, 1994

[30] Foreign Application Priority Data

Oct. 27, 1993 [DE] Germany ..... 43 36 590
Apr. 7, 1994 [DE] Germany ..... 94 05 765 U

[51] Int. Cl.[6] ..... B65D 6/18; B65D 6/26; B65D 21/032

[52] U.S. Cl. ..... 220/7; 206/508; 206/511; 220/429; 220/640

[58] Field of Search ..... 220/7, 622, 4.32, 220/676, 410, 339, 1.5, 640, 4.29; 206/504, 503, 505, 506, 509, 511, 512, 508

[56] References Cited

U.S. PATENT DOCUMENTS

| | | | |
|---|---|---|---|
| 1,682,028 | 8/1928 | Young . | |
| 3,817,371 | 6/1974 | Gatter | 220/676 X |
| 4,896,787 | 1/1990 | Delamour et al. | 220/339 |
| 5,036,979 | 8/1991 | Selz . | |
| 5,109,986 | 5/1992 | Pruitt, Jr. . | |
| 5,123,541 | 6/1992 | Giannini et al. . | |
| 5,323,921 | 6/1994 | Olsson | 220/7 X |

FOREIGN PATENT DOCUMENTS

| | | | |
|---|---|---|---|
| 0455875 | 12/1990 | European Pat. Off. . | |
| 0462085 | 12/1991 | European Pat. Off. | 206/504 |
| 472157 | 11/1914 | France . | |
| 2639911 | 6/1996 | France . | |
| 6903786 | 6/1969 | Germany . | |
| 4114862 | 10/1992 | Germany . | |
| 93040369 U | 7/1993 | Germany . | |

*Primary Examiner*—Allan N. Shoap
*Assistant Examiner*—Niki M. Kopsidas
*Attorney, Agent, or Firm*—Brumbaugh, Graves, Donohue & Raymond

[57] ABSTRACT

A receptacle has a bottom and an articulated sidewall structure which is capable of being collapsed and positioned flat on the bottom and, to enhance the static and dynamic load capacity and for simplified handling in transport, includes sidewall retention elements arranged on a bottom frame which engage matching retention recesses in the sidewall structure when it is erected and mounted on the bottom of the receptacle.

5 Claims, 26 Drawing Sheets

X
61
65

61
65

65
66
61
65

65
66
61
65

X
VII
VII
6
XXVI
XXVI

RECEPTACLE HAVING A COLLAPSIBLE SIDEWALL STRUCTURE

BACKGROUND OF THE INVENTION

This invention relates to receptacles and, more particularly, to receptacles having collapsible sidewall structures.

Receptacles with collapsible sidewall structures are conventionally used as recycling transport receptacles in the form of minicontainers and are designed for multiple circulation in goods industries. They have a bottom wall formed as a continuous floor plate or a slat arrangement on which a collapsible sidewall structure can be erected. The sidewall structure is designed as a folding unit, that is, the side and end walls are foldably connected to each other, for example, by means of straps, so that the sidewall structure is held together as a unit but can be folded and laid flat on the floor for purposes of space-saving return transport. Often, the end walls are made in two pieces which are foldable and are held together by a strap so that the sidewall structure, when laid on the floor in folded condition, will not project beyond the periphery of the floor.

One disadvantage of such receptacles of the type disclosed, for example, in German Offenlegungsschrift No. 41 14 862, is their comparatively low inherent stability in the erected condition. For this reason, they are available only as small-size containers.

Receptacles have also been disclosed which have a bottom with an underlying support structure in the form of a so-called Euro pallet, in which side walls are individually insertable and held together by connecting elements. These connecting elements are as a rule angles placed laterally outside over the edge of two abutting side walls and engaging matching recesses in the side walls as described, for example, in European Patent Publication No. 04 55 875. This arrangement provides an erected sidewall structure that is comparatively stable. For further enhancement of stability, the side walls in this arrangement are often additionally secured by means of driven nails.

A disadvantage of such receptacles, however, is their comparatively complicated handling, since numerous loose parts must be dealt with individually. Consequently, relatively prolonged, costly set-up times are incurred. Also, the erection of the sidewall structure requires a great deal of skill, since the placement of the angles is fairly complicated. Besides, during return transport in the flattened condition, a large number of structural items must be kept securely together, since there is otherwise a danger that the connecting elements especially may be lost. Presumably, this is why such receptacles, despite the generally observed trend towards package recycling, have not found great acceptance.

SUMMARY OF THE INVENTION

Accordingly, it is an object of the present invention to provide a receptacle having a collapsible sidewall structure which overcomes the above-mentioned disadvantages of the prior art.

Another object of the invention is to provide a receptacle of this type which has a high inherent stability, permitting quick and simple erection and/or collapsing, and a low production cost and, moreover, a receptacle which is stackable and suitable for transportation even under rough conditions, such as ocean transport.

These and other objects of the invention are attained by providing a receptacle having a bottom with an outer edge-encircling bottom frame in which inwardly-directed wall-retention elements are provided, and a collapsible sidewall structure formed with recesses positioned to receive the inwardly-directed wall-retention elements when the sidewall structure is erected and positioned in the bottom frame. This ensures that the sidewall structure can be firmly secured in the bottom frame as a result of its contact with the bottom frame and the engagement of the retention elements.

In a preferred wooden embodiment, it is possible, by suitable dimensioning of the parts, to connect the sidewall structure to the floor in extremely stable position by a light press fit. An automatic tendency of the sidewall structure to buckle inwardly along the articulated sidewall connections in an unfilled or only partly filled condition of the receptacle is thereby avoided.

Set-up times for the receptacle according to the invention are definitely shorter compared to those for conventional arrangements, since the collapsed sidewall structure lying flat on the receptacle floor need only be unfolded within the outline of the bottom frame and brought into inside contact with the frame. Such erecting and subsequent collapsing can be done easily and simply without instruction, even by unskilled persons. In return transport of empty receptacles, there are no separate parts which can be lost, and the flattened sidewall structure can be wedged between the floor and the retention elements in the frame. This prevents clatter and slippage.

The high stability of the sidewall structure makes it possible to stack several assembled receptacles one upon another without any problems.

A preferred embodiment of the invention includes a pallet-like bottom support structure which is offset inwardly with respect to the bottom periphery. This allows the receptacles to be stacked securely against lateral slipping.

The bottom support structure may also be arranged flush with the bottom periphery and may include additional lateral retention elements for security in transport.

In an advantageous modification, the bottom frame retention elements are pins, for example, cylindrical or rectangular dowels, and the sidewall structure recesses are matching drilled holes or apertures.

Instead of pins and apertures, laterally-projecting plates and matching sidewall slots may be used.

Alternatively, angle fittings may be mounted at the corners of the bottom frame, and the sidewall structure may be formed with matching oblique slots at the corners of the erected frame.

Another preferred embodiment includes two apertures along each side wall of the sidewall structure, and matching inwardly-directed pins in the bottom frame which are in the form of cylindrical dowels, with no retention elements associated with the end walls of the sidewall structure.

For further enhancement of static and dynamic load capacity, the receptacle according to the invention may include a top frame for the sidewall structure which substantially matches the outline of the bottom frame.

The top frame preferably is an assembly of L-shaped metal angle bars which, in the collapsed condition of the sidewall structure, is positioned on the bottom frame flush with the periphery thereof. The top frame includes one or more holding clips projecting downwardly which are received within the bottom frame. In the erected condition of the sidewall structure, the top frame is mounted onto the top edges of the walls from above, and the holding clips embrace the side walls from the outside and thereby radically enhance stability, especially avoiding outward bellying of the walls. The holding clips may include angle corner clips at the corners of the top frame and guide clips along the walls of the sidewall structure. In a modified form, some of the holding clips may be offset inwardly so that the top frame, when placed on top of the assembled sidewall structure, prevents any buckling of the walls either outwardly or inwardly. Preferably, the holding clips grip the side walls on both sides in staggered relation and are arranged in the region of the articulated connections of adjacent walls of the sidewall structure.

In another preferred embodiment, in which all of the holding clips of the top frame embrace the sidewall structure from the outside, the top frame includes locking elements at the holding clips positioned to engage matching locking recesses in the corresponding sidewall structure. These locking elements and recesses are thus comparable to the retention elements and recesses around the bottom frame. In this embodiment, the top frame is placed on the sidewall structure when it is positioned on the bottom frame but not yet completely unfolded, after which the sidewall structure is unfolded completely and locked into both the bottom frame and the top frame.

For further advantageous security in transport, the bottom frame has recesses milled on the inside which are engaged by the holding clips of the top frame when it is positioned thereon. The top frame is thus firmly fixed in position, secure against slipping.

For rapid, dependable and easily-handled erection of the sidewall structure, the adjacent edges of the walls are formed with grooves in which a flexible strip is inserted, which may be fixed in the grooves by clamping, bonding or pinning in a simple manner. The grooves may also be provided with a covering at both ends. This mode of providing an articulated connection has the advantage over known arrangements using hinges or the like in that it is simply, inexpensively and quickly produced and, when the sidewall structure is erected or collapsed, pinching of human limbs or inanimate objects is reliably prevented. In addition, an attractive visual appearance is provided.

Advantageously, the receptacle according to the invention provides a lidless transport container of high static and dynamic load capacity, requiring extremely short set-up times.

The receptacle includes at most three handling parts: the bottom, the sidewall structure, and the top frame, if any, none of which can be lost. It is suitable especially for receptacles of larger dimensions, preferably those of a so-called Euro pallet. Such receptacles can therefore be placed and stacked in advantageous manner in conventional warehouse shelving, on roller conveyors, or in other larger containers.

The extremely low height of the receptacle in the collapsed condition permits the arrangement of about 25 percent more receptacles in a commercial 40-foot transport container than is possible with conventional receptacles, for example.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1B:
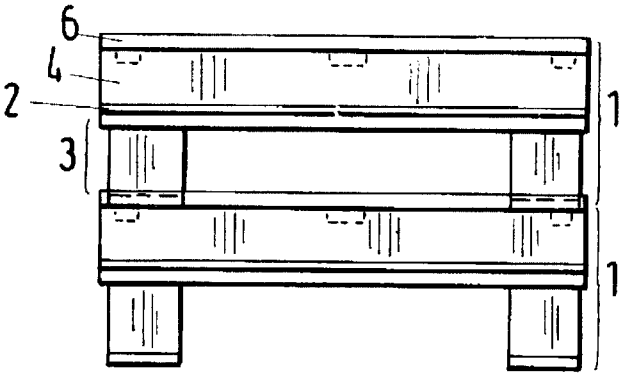
FIGS. 1A and 1B are side and end views, respectively, of two receptacles according to a first representative embodiment of the invention which are stacked with their sidewall structures collapsed.

In the typical embodiment of the invention shown in FIGS. 1A and 1B and 2 and FIGS. 5–9B, a receptacle 1 has a bottom 2 which is mounted on a support structure 3. The support structure is arranged to enable the receptacle 1 to be picked up and transported (in a manner not illustrated) with the fork of a forklift truck or handlift car. In its basic dimensions, therefore, the support structure more or less matches those of a so-called Euro pallet, so that full compatibility with the worldwide Euro pallet is achieved in terms of logistics.

The support structure 3 consists of two rows of blocks 31 and 32 with corner blocks 32 located in the corner regions and supporting blocks 31 located halfway between them, each row of blocks being stabilized by a connecting slat 33. By contrast with the underpass construction of Euro pallets, the supporting structure is not quite flush with the periphery of the bottom 2, but is slightly recessed. This permits the supporting structure to be fitted within a top frame 6 when the receptacles are stacked, thereby securing it against sidewise shifting.

The bottom 2 of the receptacle, which in the illustrated embodiment is in the form of a continuous floor plate 21, has a bottom frame 4 which is positioned flush with the periphery of the bottom floor plate. The bottom frame 4 includes two end slats 42 and two side slats 43, which are mounted flush with the periphery of the floor plate 21. In accordance with the invention, the bottom frame is provided with inwardly-directed sidewall retention elements and, in the embodiment of FIGS. 1A and 1B and 2 and FIGS. 5–9B, two pins 45, spaced apart and directed inwardly, are arranged on each side slat 43 for this purpose.

Figure 5:
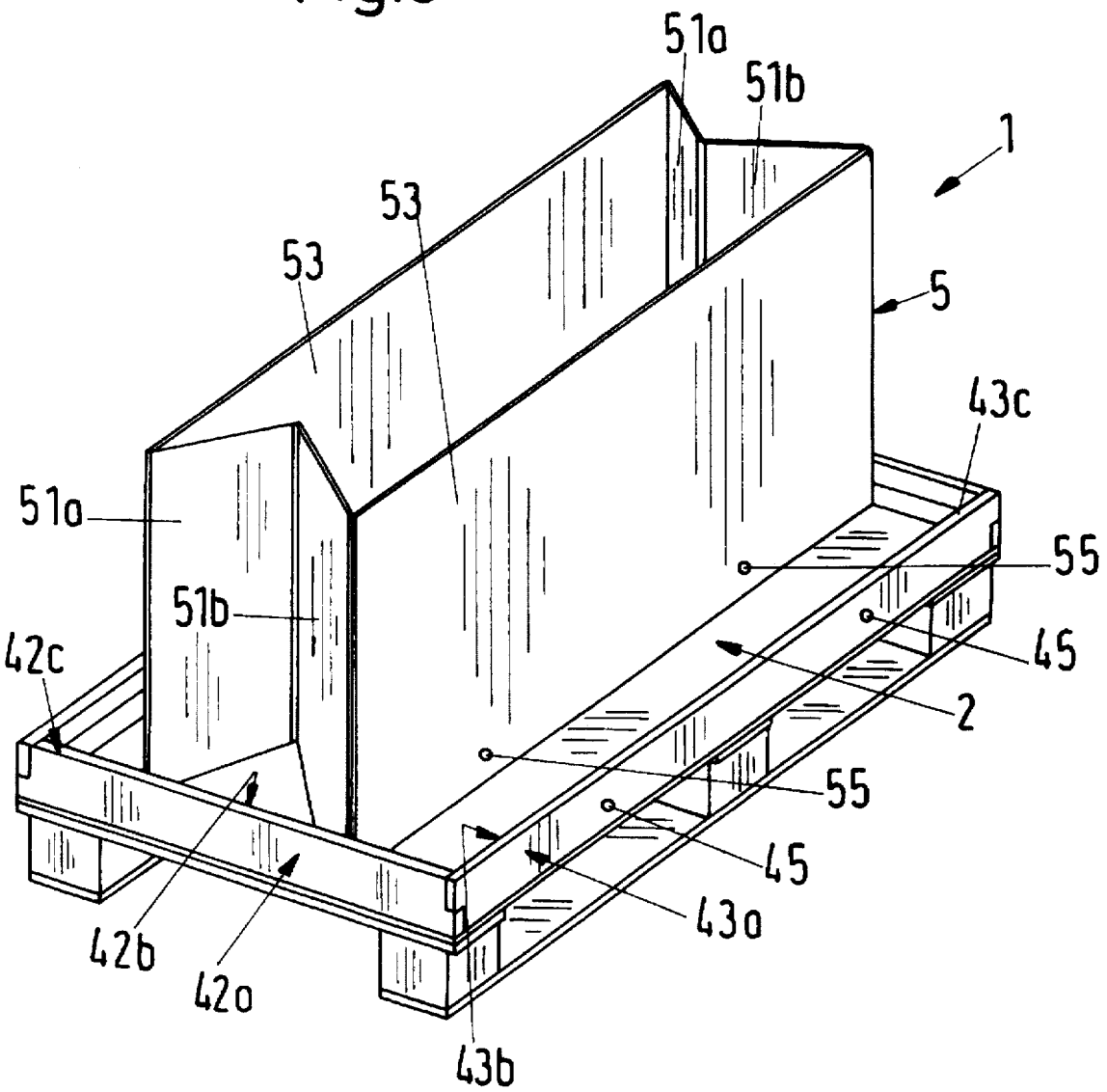
FIG. 5 is a perspective view of the receptacle shown in FIG. 2 with the sidewall structure erected on the bottom frame but still partly folded.

As shown in FIG. 5, an articulated sidewall structure 5, formed of two end walls 51 and two side walls 53, is provided for the receptacle. The end walls 51 are jointed, each consisting of the two panels 51*a* and 51*b*. All of the sidewall panels 51*a*, 51*b* and 53 are foldably connected to each other so that the sidewall structure 5 is collapsible as a unit. Thus, it is possible to collapse the sidewall structure by folding the panels 51*a* and 51*b* inwardly and laying them flat on the bottom 2 as required, or else to erect it and bring it into engagement with the inner surface of the bottom frame 4. In the folded condition, the sidewall structure 5 is laid flat on the bottom 2 and does not project beyond the area defined by the bottom frame 4. The height of the bottom frame slats 42 and 43 is chosen so that, when the sidewall structure 5 is laid flat on the bottom 2, the frame will extend at least slightly above it. This permits another receptacle 1 to be superimposed so that its support structure 3 can rest on the bottom frame 4, or on a top frame 6 placed upon it, without touching the folded sidewall structure 5 which is lying flat inside the bottom frame 4.

Figure 1A:
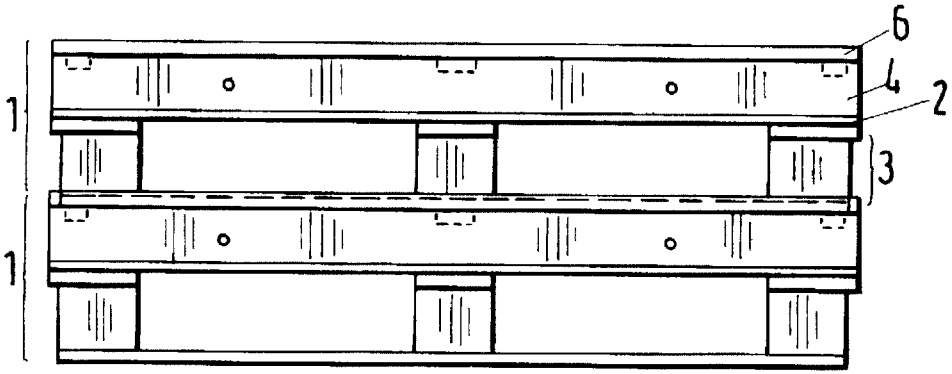

This condition is represented in FIGS. 1A and 1B, in which two receptacles 1 with sidewall structures 5 laid flat (not visible) are stacked one upon the other. The support structure 3 of the upper receptacle 1 is inserted in the top frame 6 of the receptacle 1 beneath, so that the two receptacles 1 are exactly aligned. All components of the receptacle 1, namely, the bottom frame 4, the top frame 6 and the support structure 3, have dimensions so chosen that they do not project outward anywhere beyond the bottom 2, and therefore the standardized overall dimensions are nowhere exceeded.

Figure 2:
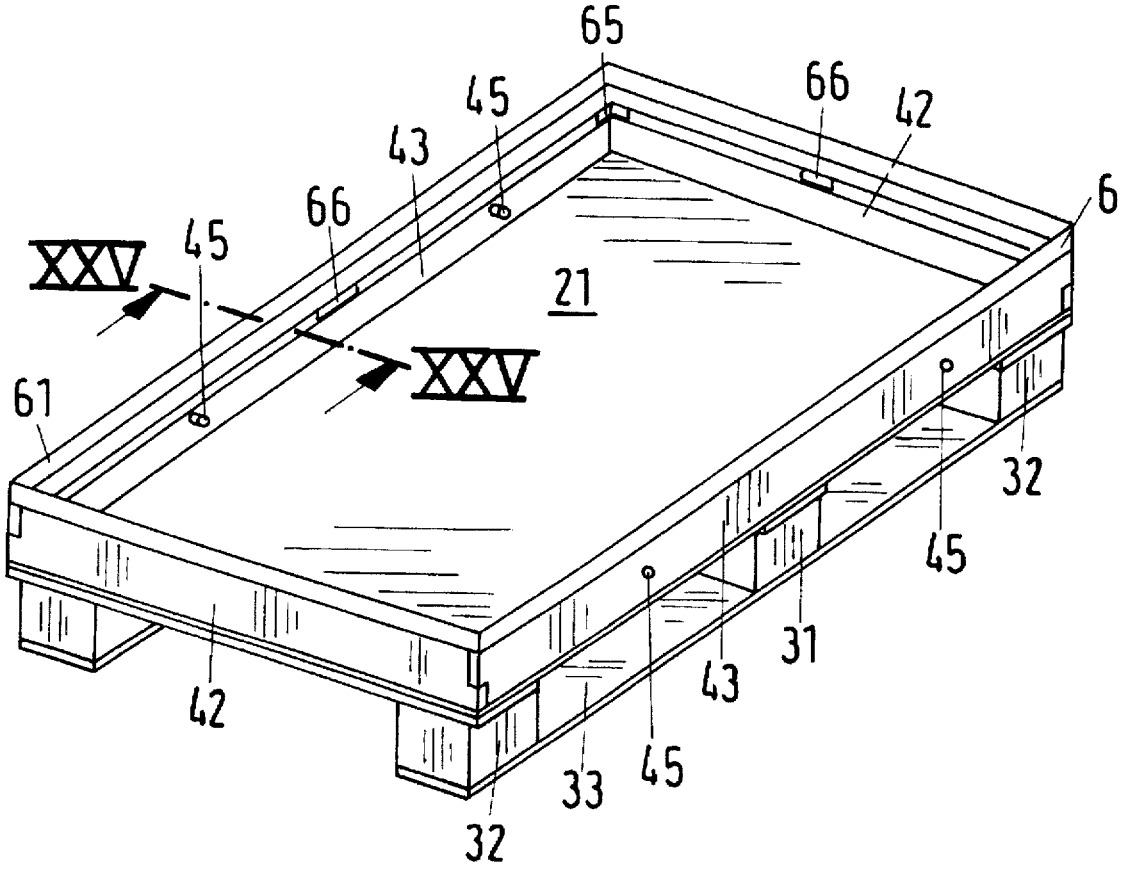
FIG. 2 is a perspective view of one of the receptacles shown in FIGS. 1A and 1B.

In FIG. 2, a single receptacle 1 is shown, with the top frame 6 resting on the bottom frame 4. As shown in greater detail in FIGS. 7A–7E, holding cleats in the form of corner cleats 65 and locating cleats 66 are attached to the top frame 6. These cleats engage the inside surfaces 42*b* and 43*b* (see FIG. 6) of the side and end slats 42 and 43 of the bottom frame and position the top frame 6 in relation to the bottom frame 4. The top frame 6 also has an encircling molding 61 of L-shaped cross-section, as best seen in FIG. 7D, thus being capable of laterally retaining the support structure 3 of an additional receptacle 1.

Figure 3:
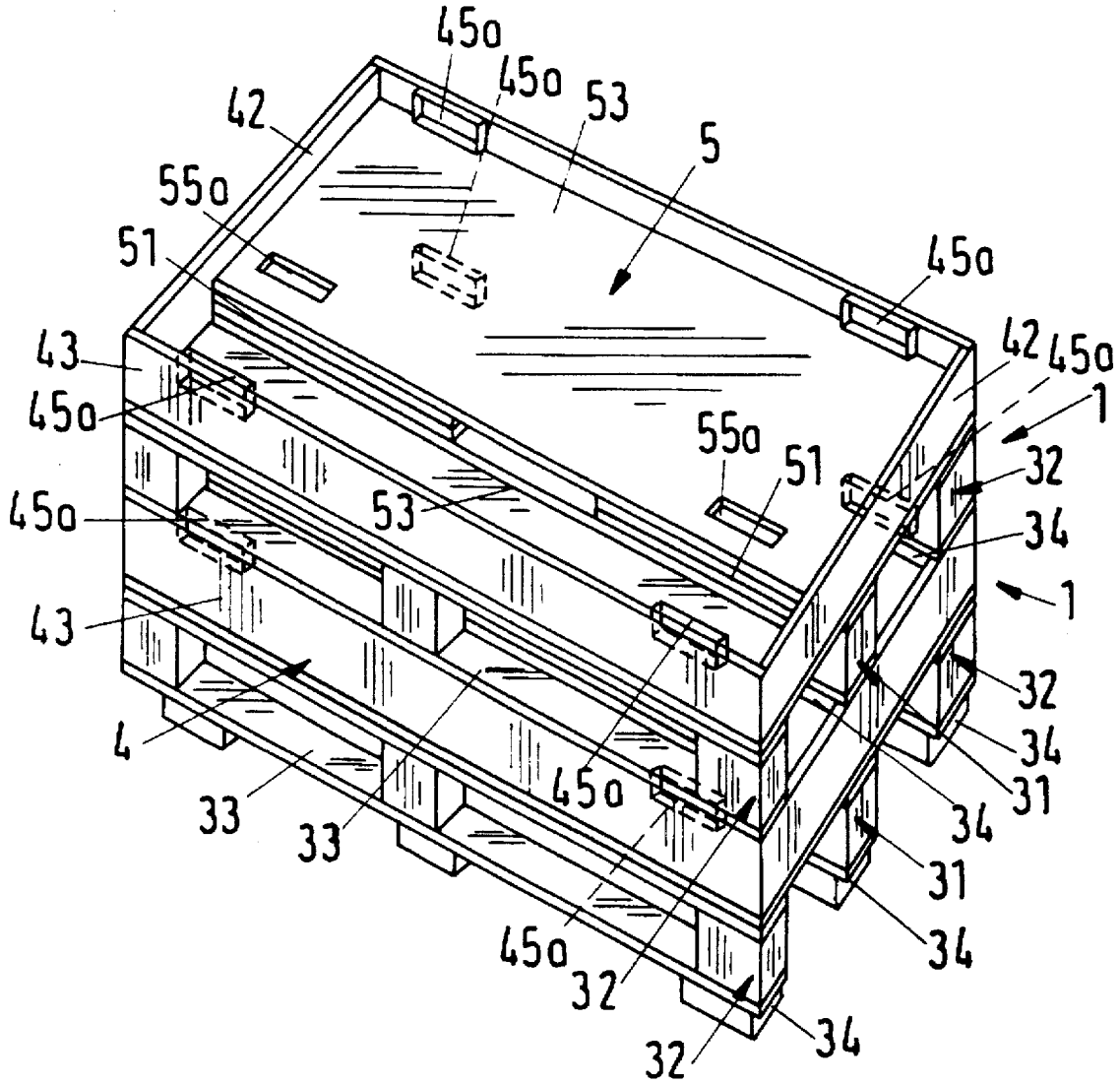
FIG. 3 is a perspective view showing two stacked receptacles with collapsed sidewall structures according to a modified form of the invention.
Figure 4:
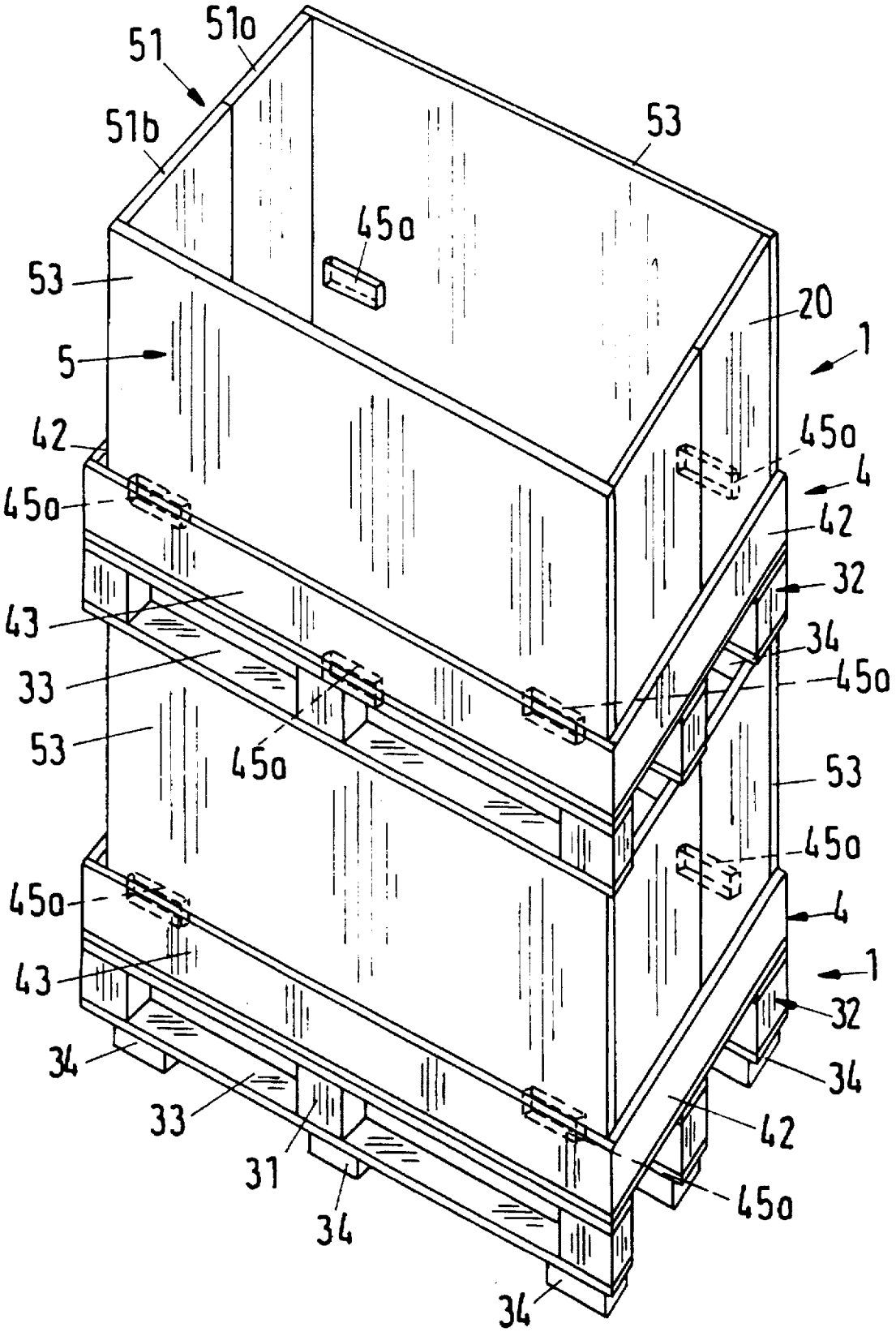
FIG. 4 is a perspective view of the receptacles shown in FIG. 3 with the sidewall structure erected and the receptacles stacked.

FIGS. 3 and 4 show a modification of the first embodiment. In this case, the support structure 3 is made flush with the periphery of the bottom 2 or the bottom frame 4 and has feet 34 which are offset inwardly on the support structure 3 so as to be received within a lower receptacle 1 when stacked in nested fashion.

The retention elements in this embodiment are in the form of rectangular lugs 45*a* which, in the erected condition of the sidewall structure 5, as shown in FIG. 4, engage the corresponding retention recesses which are in the form of rectangular apertures 55*a*.

FIG. 3 makes clear how the sidewall structure 5, when collapsed, is retained between the bottom 2 and the lugs 45*a* of one lengthwise bottom frame slat 43.

In FIG. 5, the top frame 6 has been removed from the bottom frame so that the sidewall structure 5 can be erected on the bottom plate 21. At this stage, the sidewall structure 5 is still partly folded, that is, the panels 51*a* and 51*b* have not yet been straightened out to make continuous end walls 51. In the lower portion of each of the side walls 53, two openings 55 in the form of drilled holes are provided which are aligned with two pins 45. Four of these pins 45 are attached to the bottom frame 4, two pins 45 being fixed in spaced relation in each of the side frame slats 43.

Figure 6:
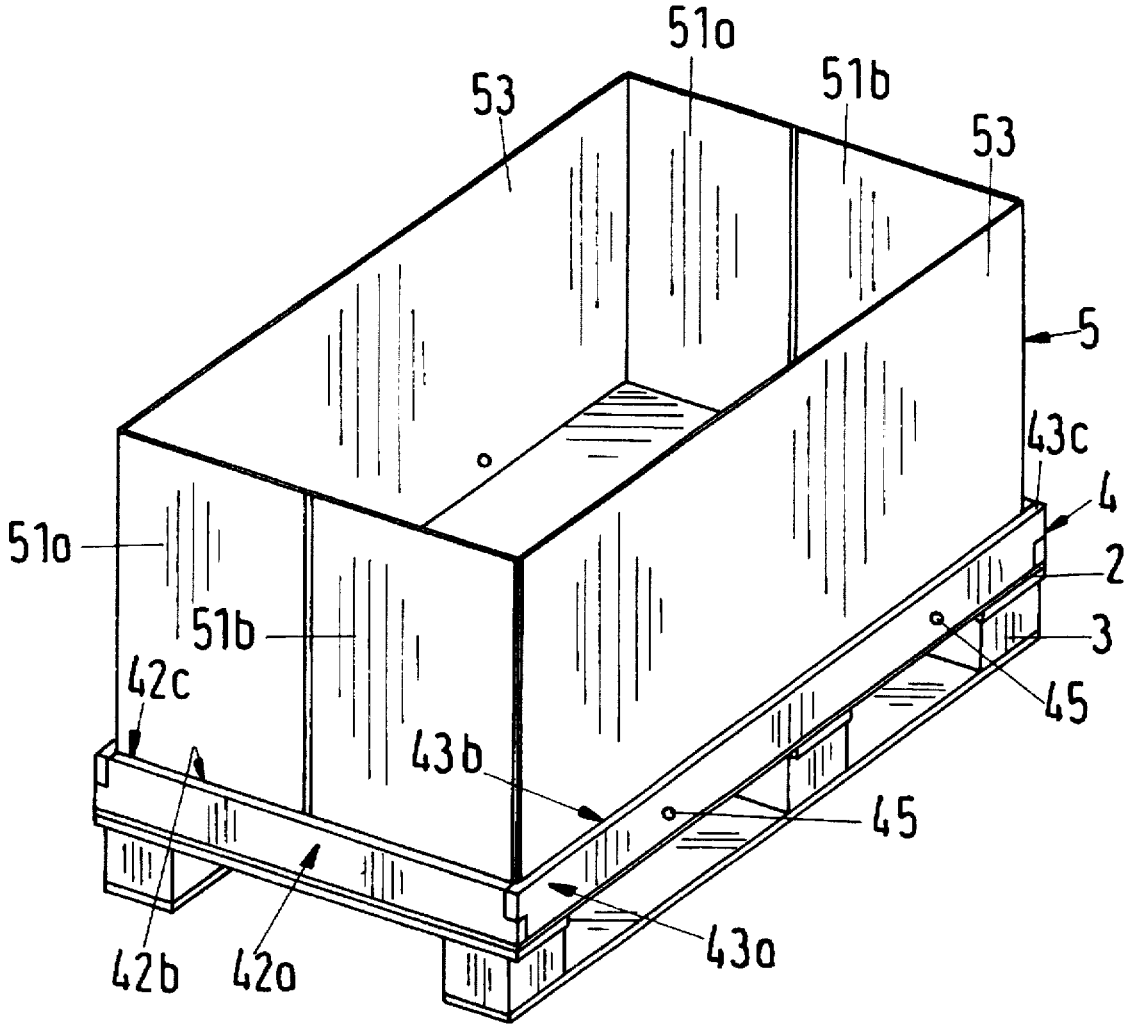
FIG. 6 is a perspective view showing the receptacle of FIG. 5 with the sidewall structure completely unfolded and secured in the bottom frame.
Figures 7A, 7B, 7C, 7D, 7E:
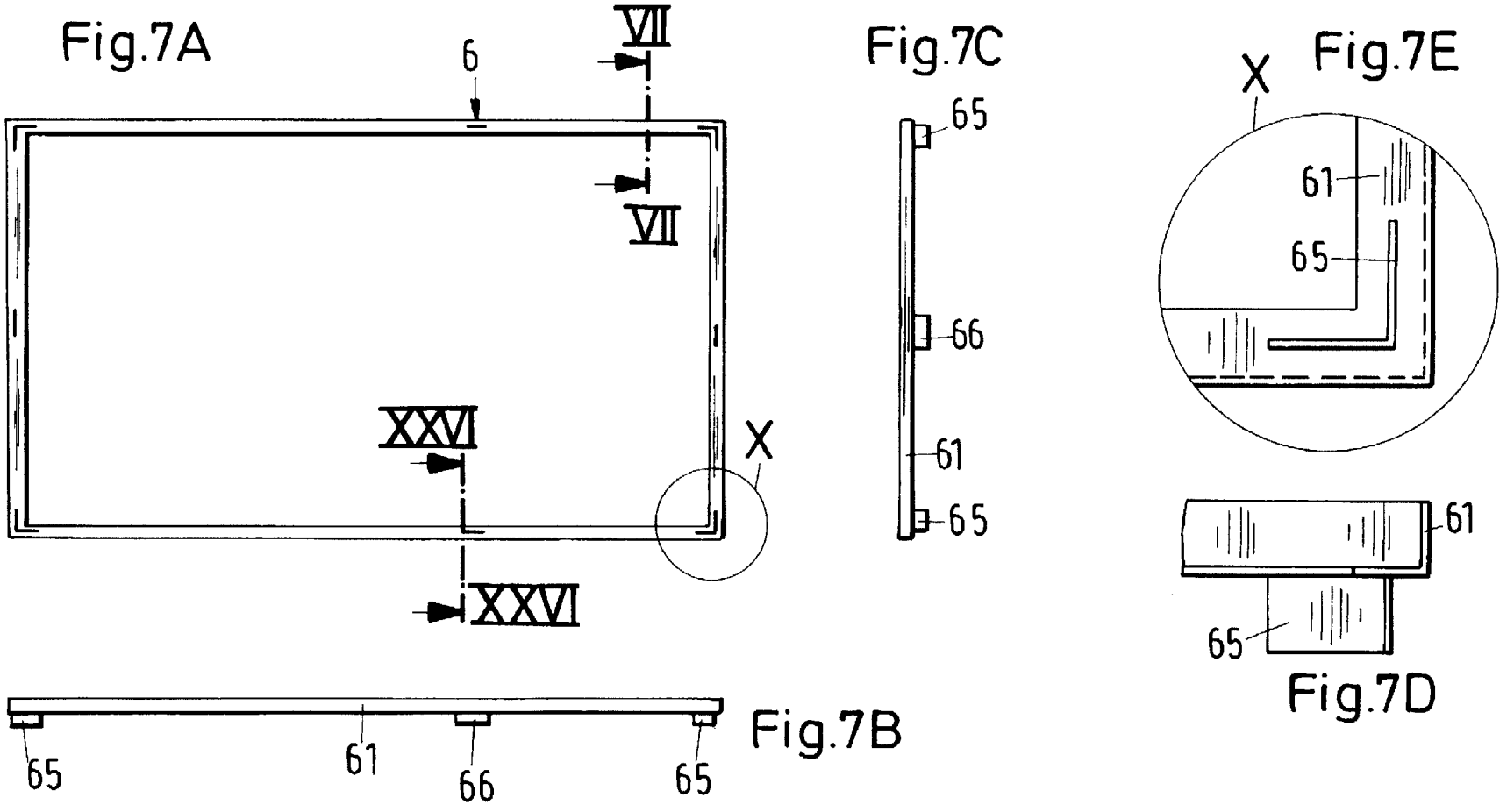
FIGS. 7A, 7B and 7C are bottom, side and end views, respectively, of a top frame for a receptacle according to the invention.
FIG. 7D is an enlarged sectional view of the frame shown in FIG. 7A, taken along the line VII—VII.
FIG. 7E is an enlarged fragmentary view showing one corner of the top frame.

In the position shown in FIG. 6, the sidewall structure 5 has been completely erected, each of the end walls 51 and side walls 53 having been brought into engagement at the bottom with the inside surfaces 42*b* and 43*b* of the bottom frame slats 42 and 43. The pins 45 have entered the holes so that the sidewall structure is fixed in relation to the bottom frame 4.

Figure 8:
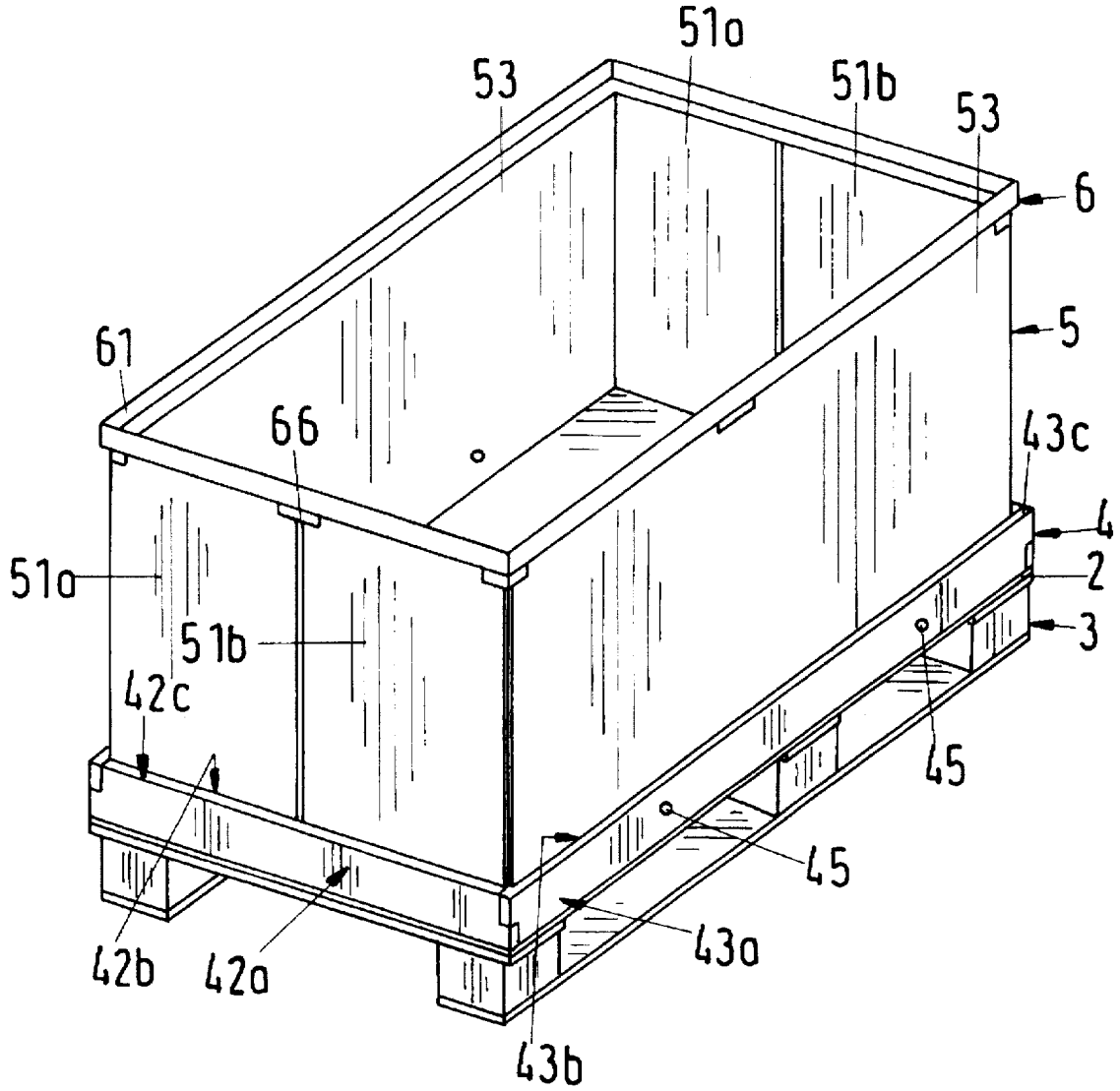
FIG. 8 is a perspective view of the receptacle of FIG. 6 with the top frame mounted on the sidewall structure.

For further enhancement of stability of the sidewall structure 5, the top frame 6, shown in FIGS. 7A–7E, is placed on the end walls 51 and side walls 53 from above, with the corner cleats 65 and locating cleats 66 positioned outside the end walls 51 and side walls 53, as shown in FIG. 8. Any outward dislodgement of the sidewall structure 5 due to loading with additional superimposed receptacles 1 or bulk transport goods inside the sidewall structure 5 is thus prevented since all walls are retained both by the top frame 6 at the top and by the bottom frame 4 at the bottom.

Figure 9B:
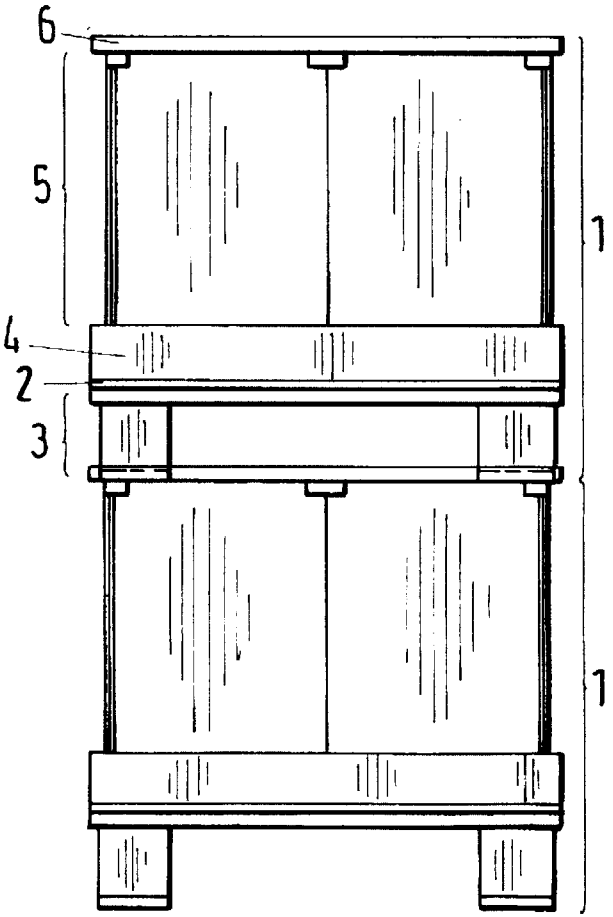
FIGS. 9A and 9B are side and end views, respectively, showing two stacked receptacles with erected sidewall structures of the type shown in FIG. 8.
Figure 9A:
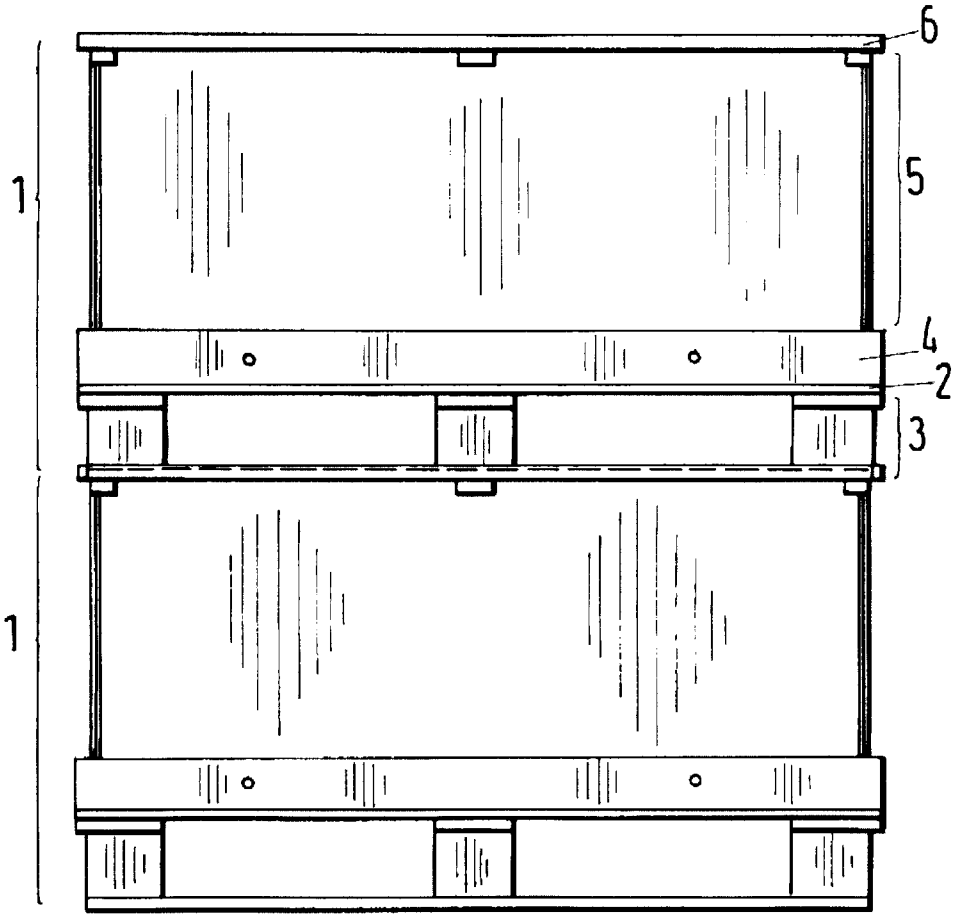
Figure 10B:
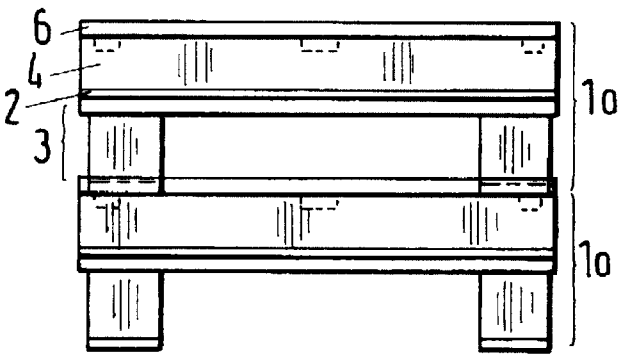
FIGS. 10A and 10B are side and end views, respectively, showing two receptacles according to another representative embodiment of the invention in stacked relation with their sidewall structures collapsed.
Figure 10A:
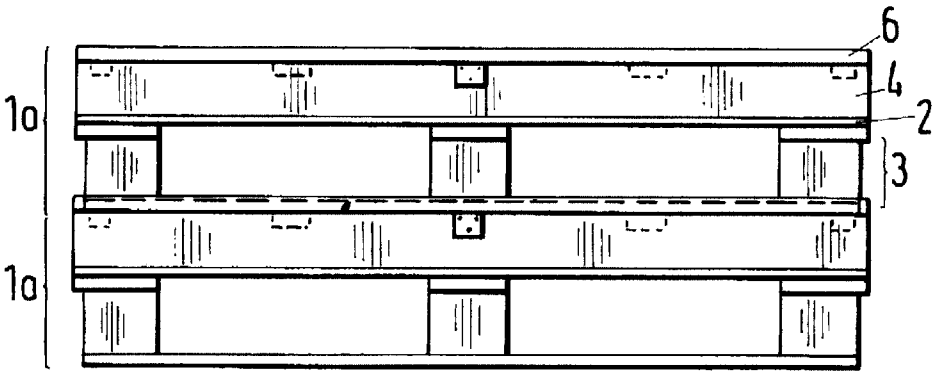
Figure 11:
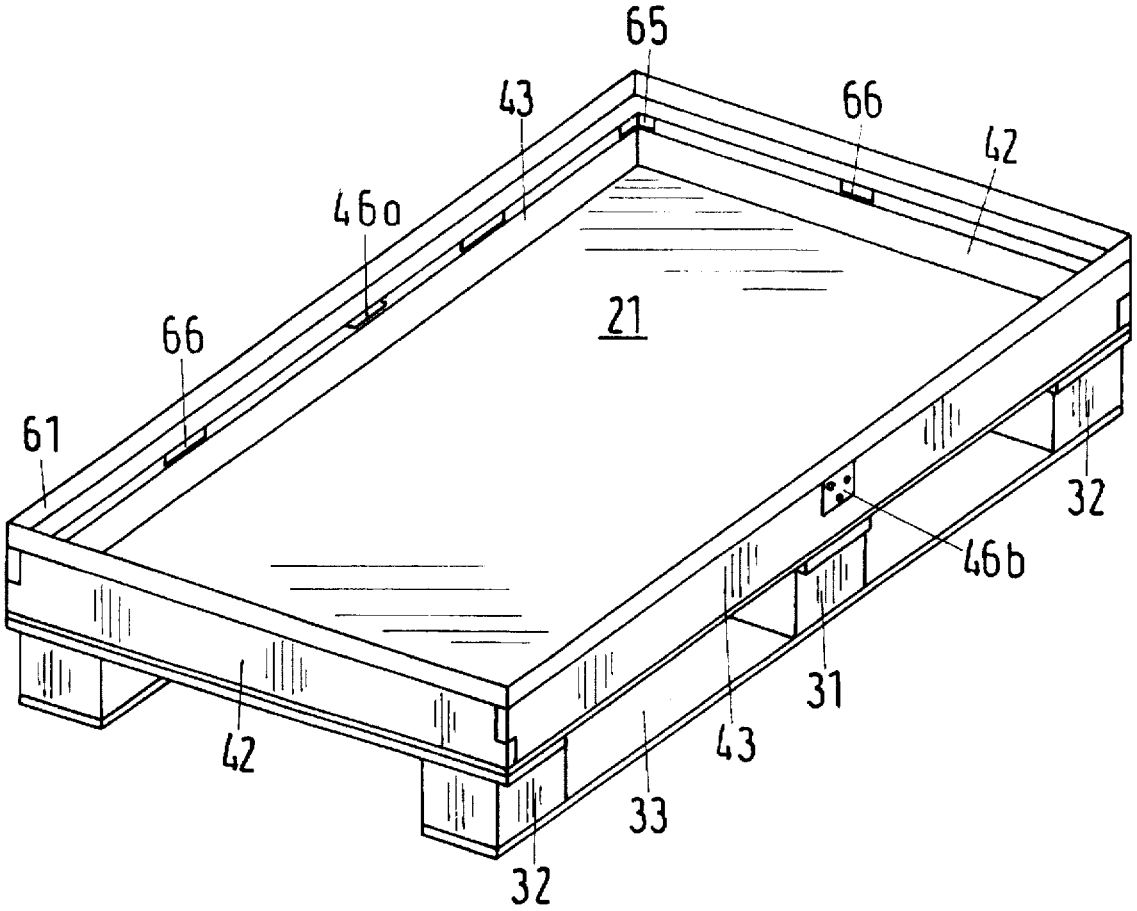
FIG. 11 is a perspective view showing one of the receptacles illustrated in FIGS. 10A and 10B.
Figure 12:
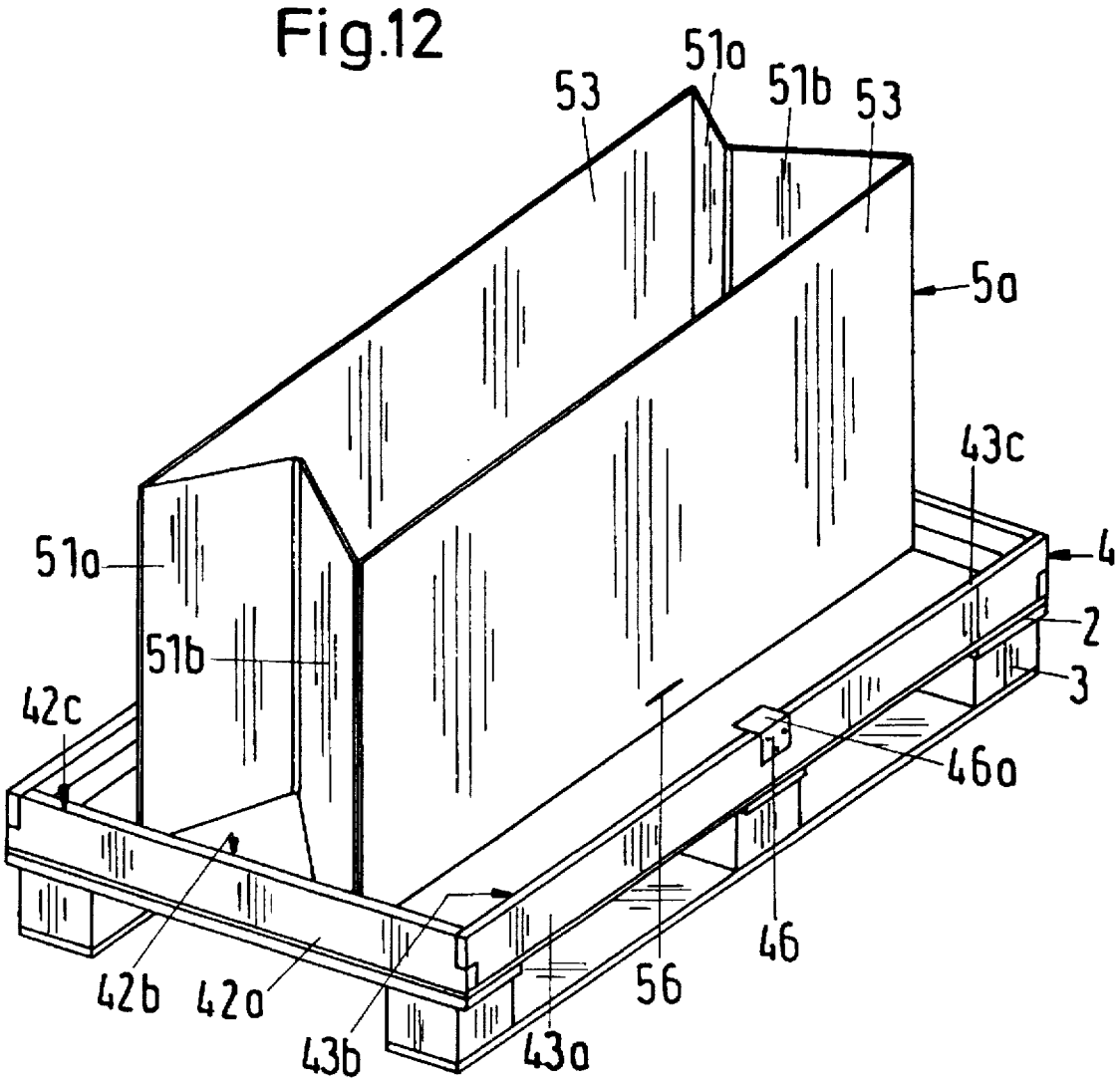
FIG. 12 is a perspective view showing the receptacle of FIG. 11 with a sidewall structure erected on the bottom frame but still partly folded.
Figure 13:
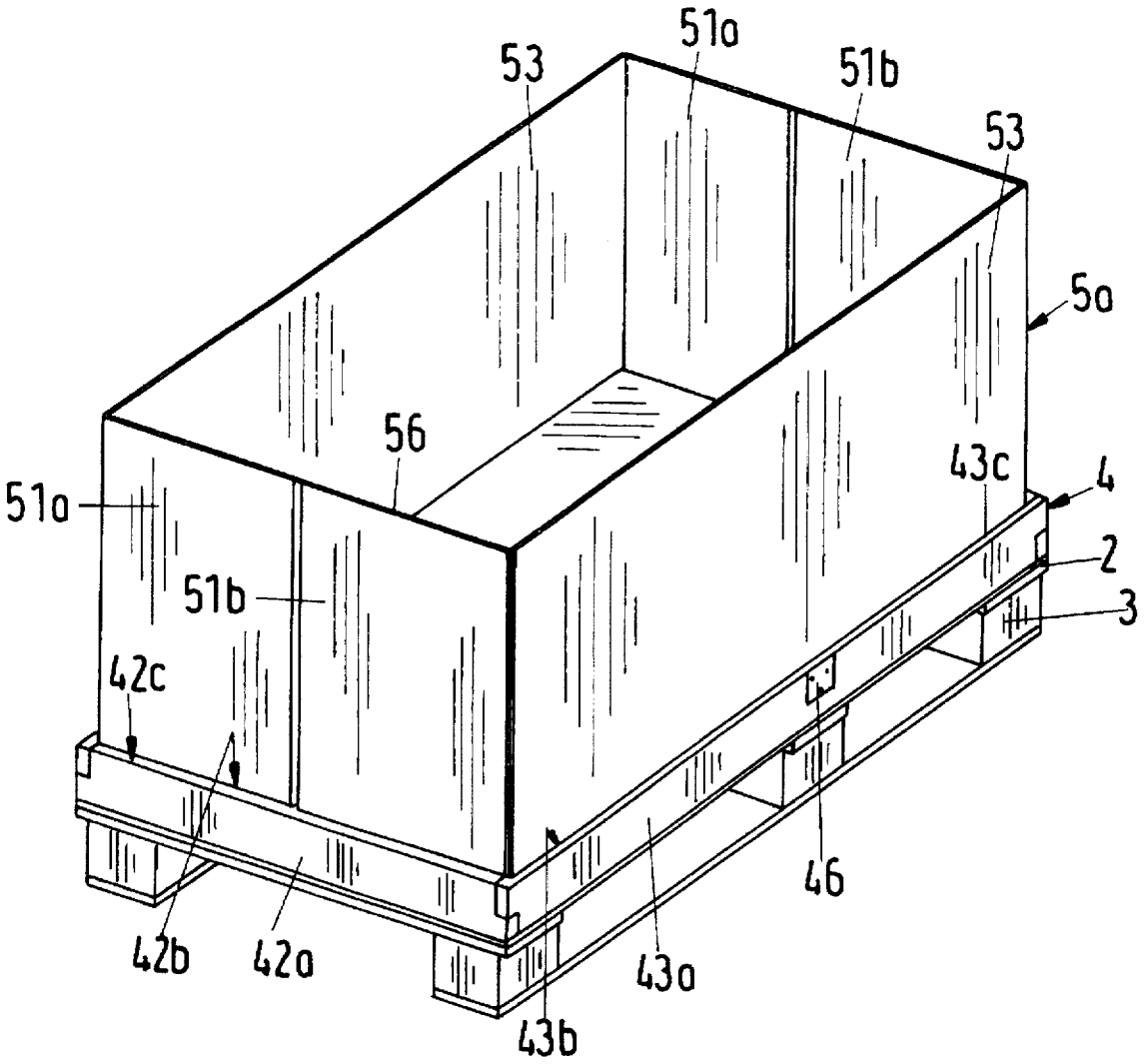
FIG. 13 is a perspective view showing the receptacle of FIG. 12 with the sidewall structure completely unfolded and secured in the bottom frame.
Figure 14:
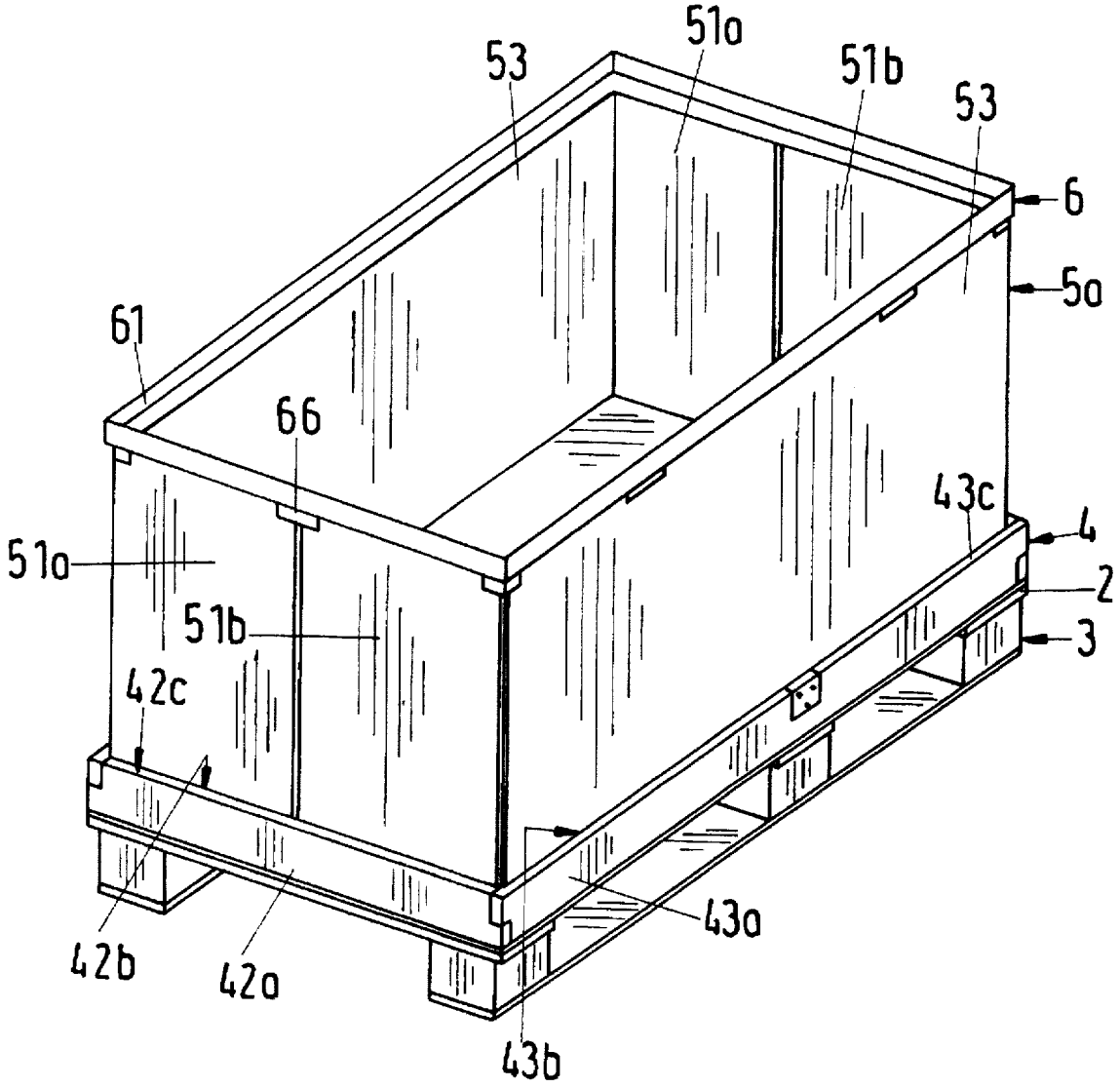
FIG. 14 is a perspective view showing the receptacle of FIG. 13 with the top frame mounted on the sidewall structure.
Figure 15B:
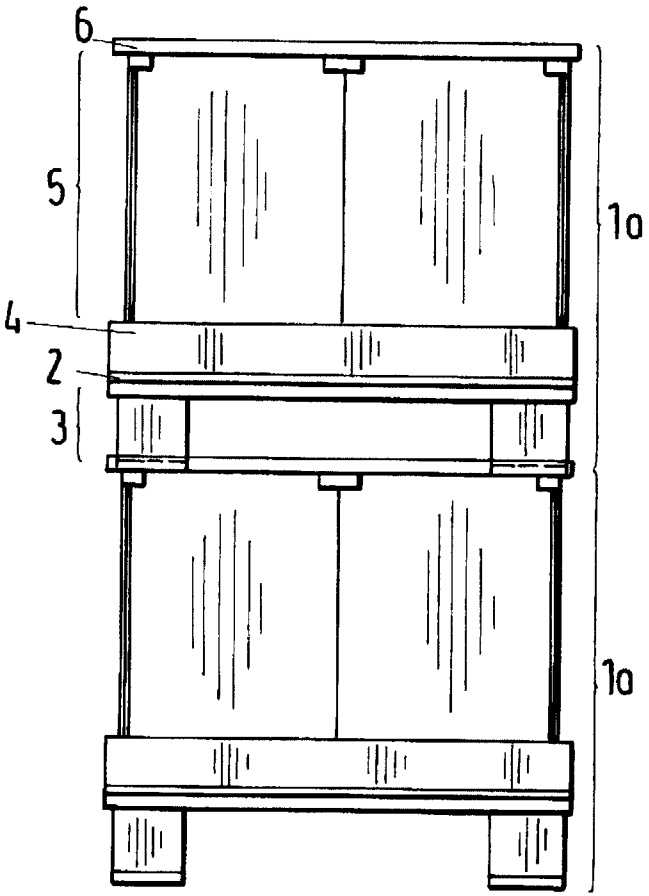
FIGS. 15A and 15B are side and end views, respectively, showing two stacked receptacles with erected sidewall structures of the type shown in FIG. 14.
Figure 15A:
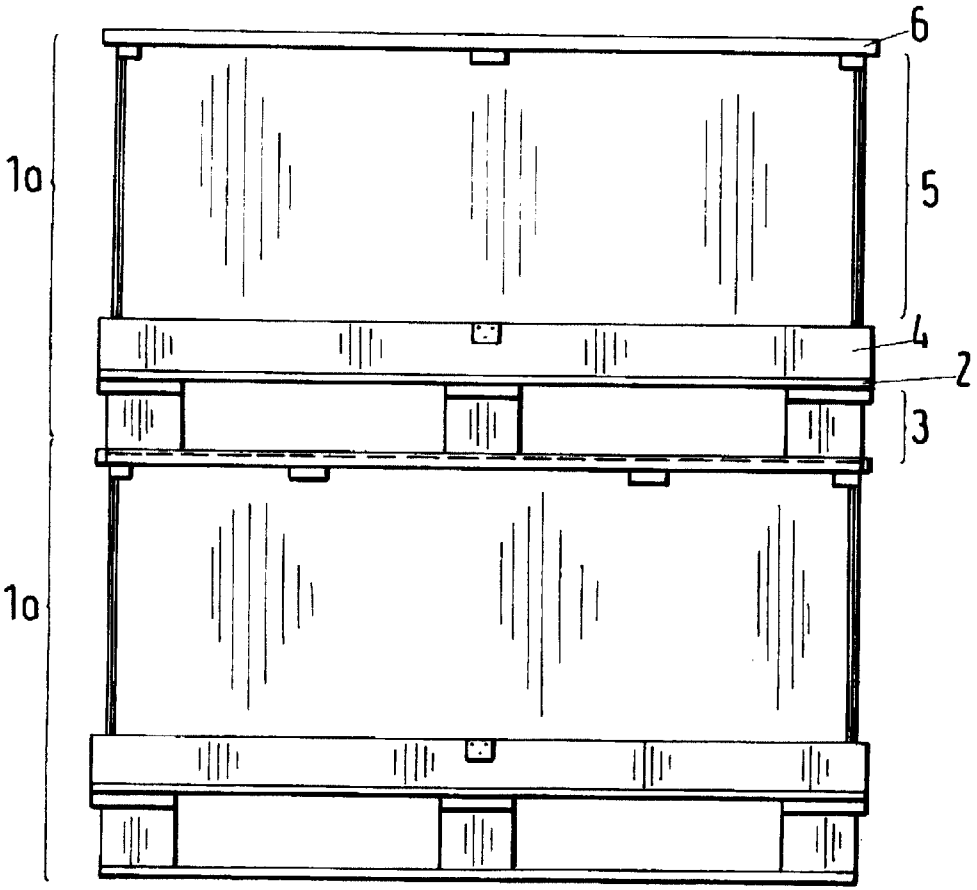
Figure 17:
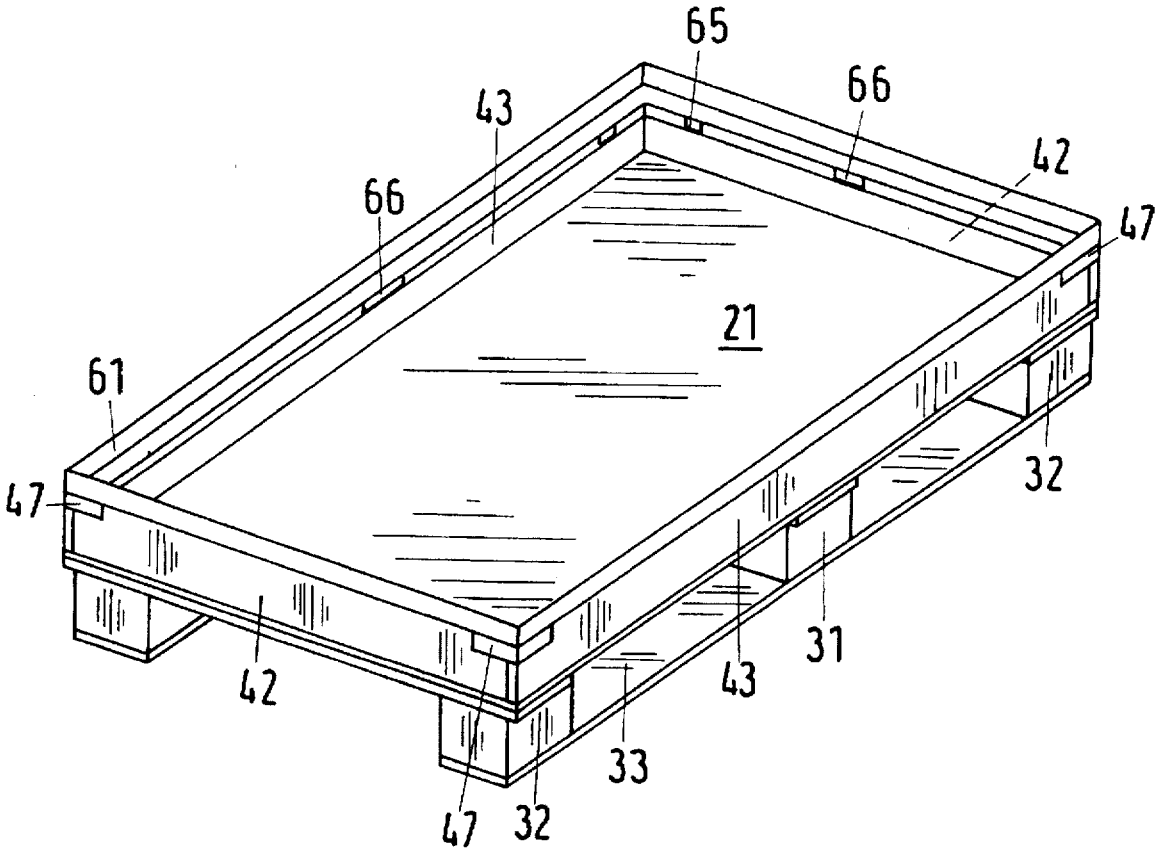
FIG. 17 is a perspective view showing one of the receptacles illustrated in FIGS. 16A and 16B.
Figure 16B:
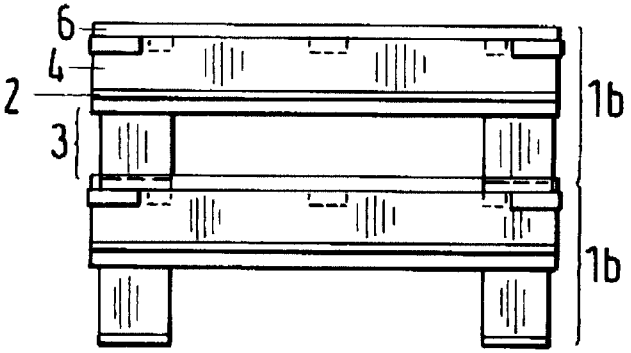
FIGS. 16A and 16B are side and end views, respectively, showing two stacked receptacles according to a further representative embodiment of the invention with their sidewall structures collapsed.
Figure 16A:
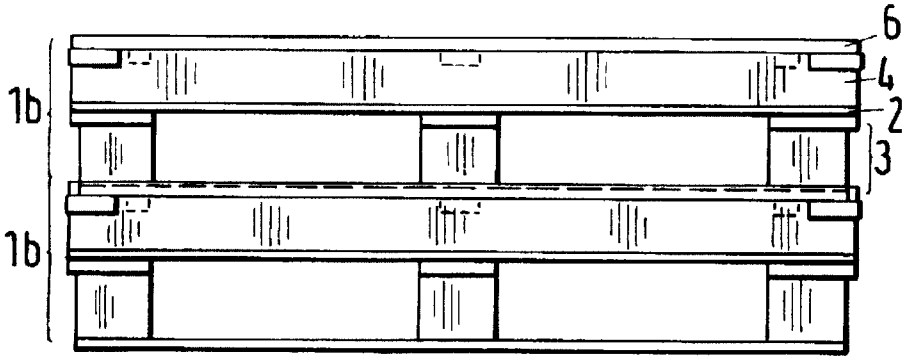

FIGS. 9A and 9B show two stacked receptacles 1 according to this embodiment with the sidewall structures in the erected condition.

From the foregoing, it will be apparent that the receptacle according to the invention can be collapsed and laid flat quickly and with little effort for space-saving return transport and, moreover, that the sidewall structure in combination with the retention elements in the bottom frame provides an extremely stable receptacle conforming to the most exacting requirements. It is thus possible to provide large containers of this type having the dimensions of a Euro pallet.

In the further representative embodiment of the invention shown in FIGS. 10A–15B, a receptacle 1*a* has a structure which is largely similar to the receptacle 1 described above. The differences in structure are primarily in the configuration of the retention elements and the corresponding retention recesses made in the side walls 53. In this embodiment, as best seen, for example, in FIG. 12, the retention element is in the form of angle members 46 mounted on the side slats of the bottom frame, each having a plate 46*a* directed inwardly to engage a corresponding slot 56 formed in the side wall 53 of the sidewall structure 5*a*. The other leg 46*b* of the angle member 46 is screw-fastened to the outside surface 43*a* of the side slat, permitting the angle member 46 to be placed on the bottom frame from the outside. This mode of attachment of retention devices is simpler and cheaper than that required for the pins 45 and blocks 45*a* of the embodiments previously described. If the angle member 46 is generously dimensioned, it may suffice to attach only one of these angle members 46 to the side slat 43. In practice, it imparts the same stability as the two pins 45 or blocks 45*a* of the embodiments previously described, but is simpler to make.

Figure 18:
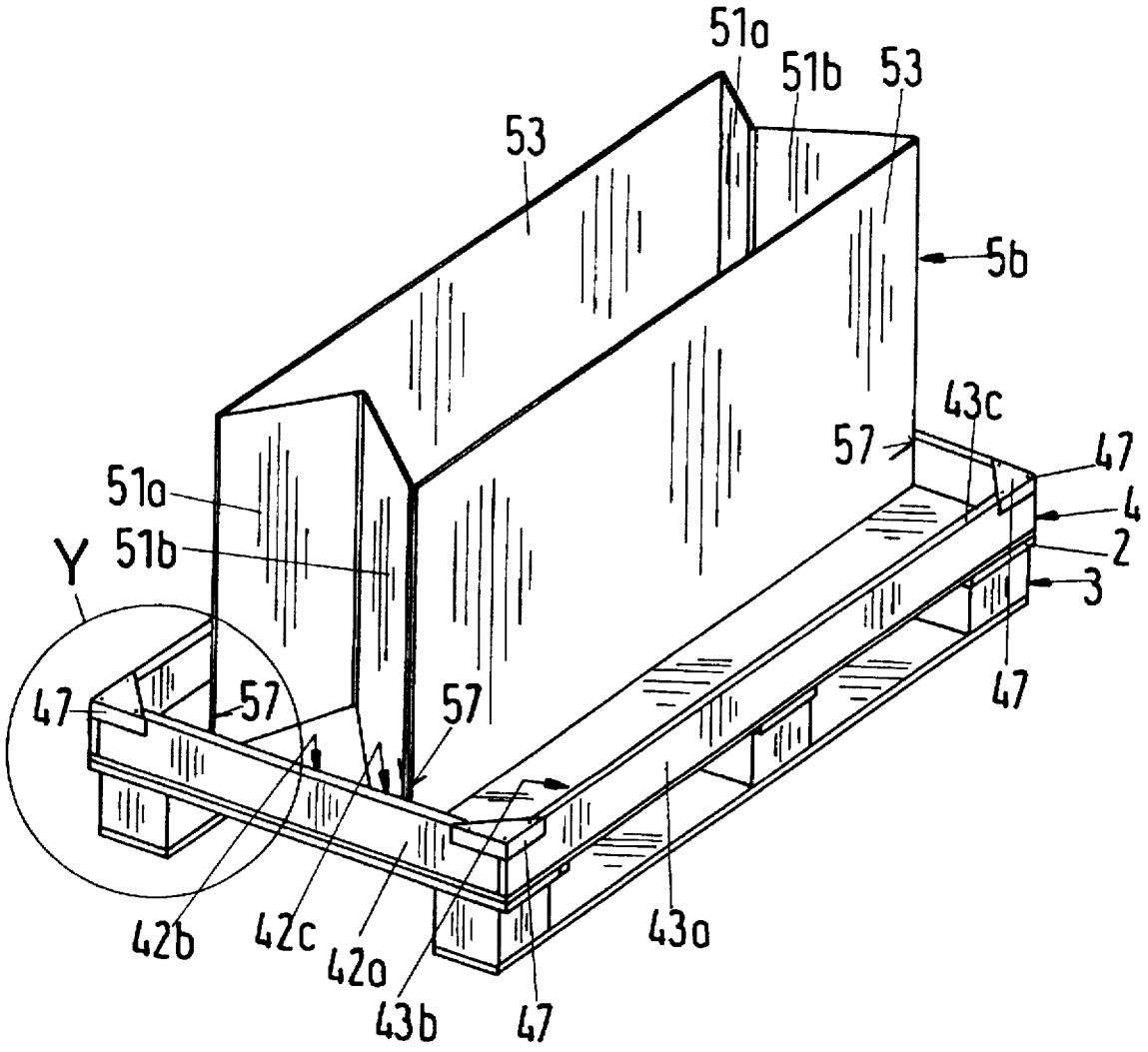
FIG. 18 is a perspective view showing the receptacle of FIG. 17 with a sidewall structure erected on the bottom frame but still partly folded.
Figure 19:
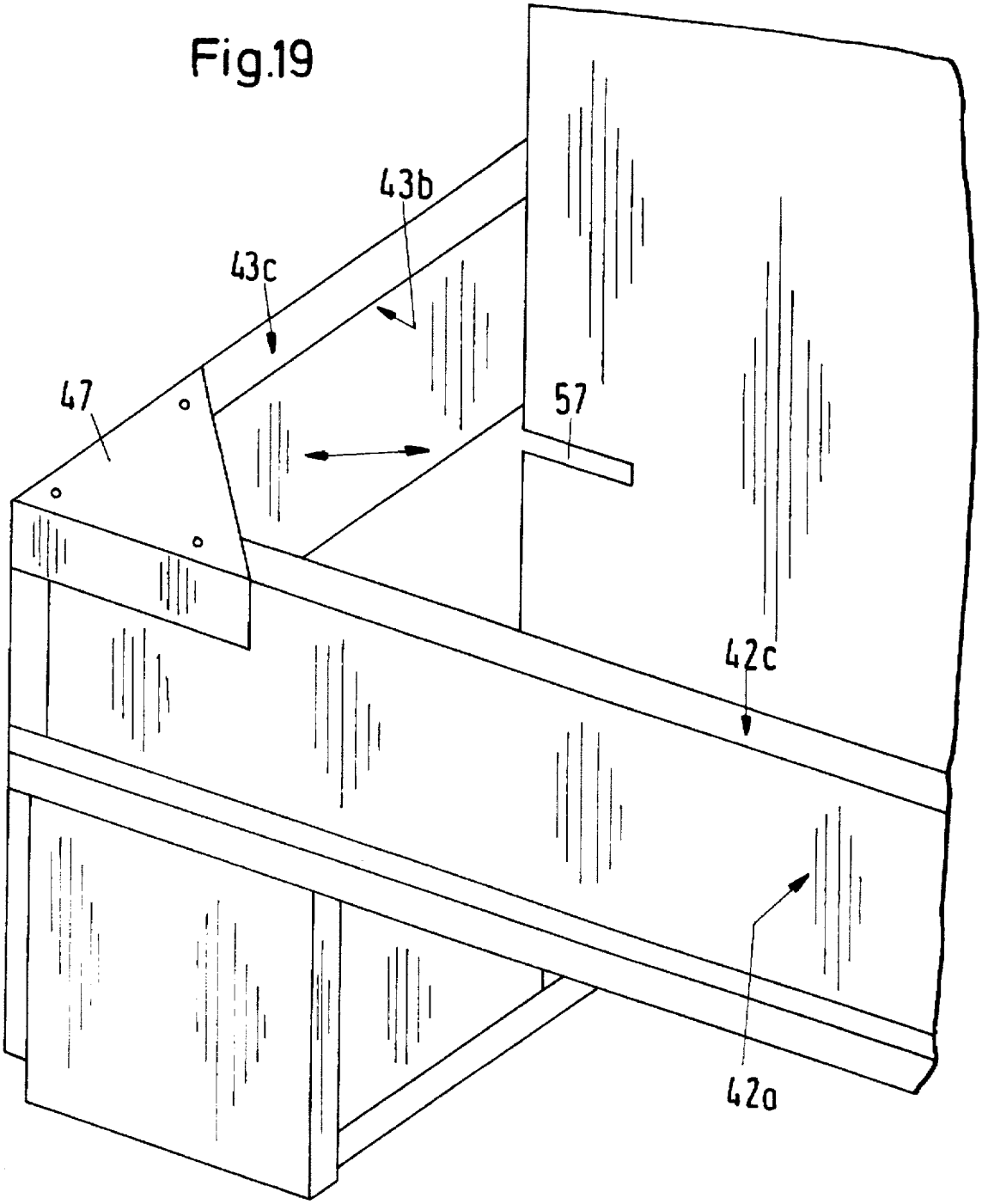
FIG. 19 is an enlarged fragmentary perspective view showing a portion of the receptacle illustrated in FIG. 18.
Figure 20:
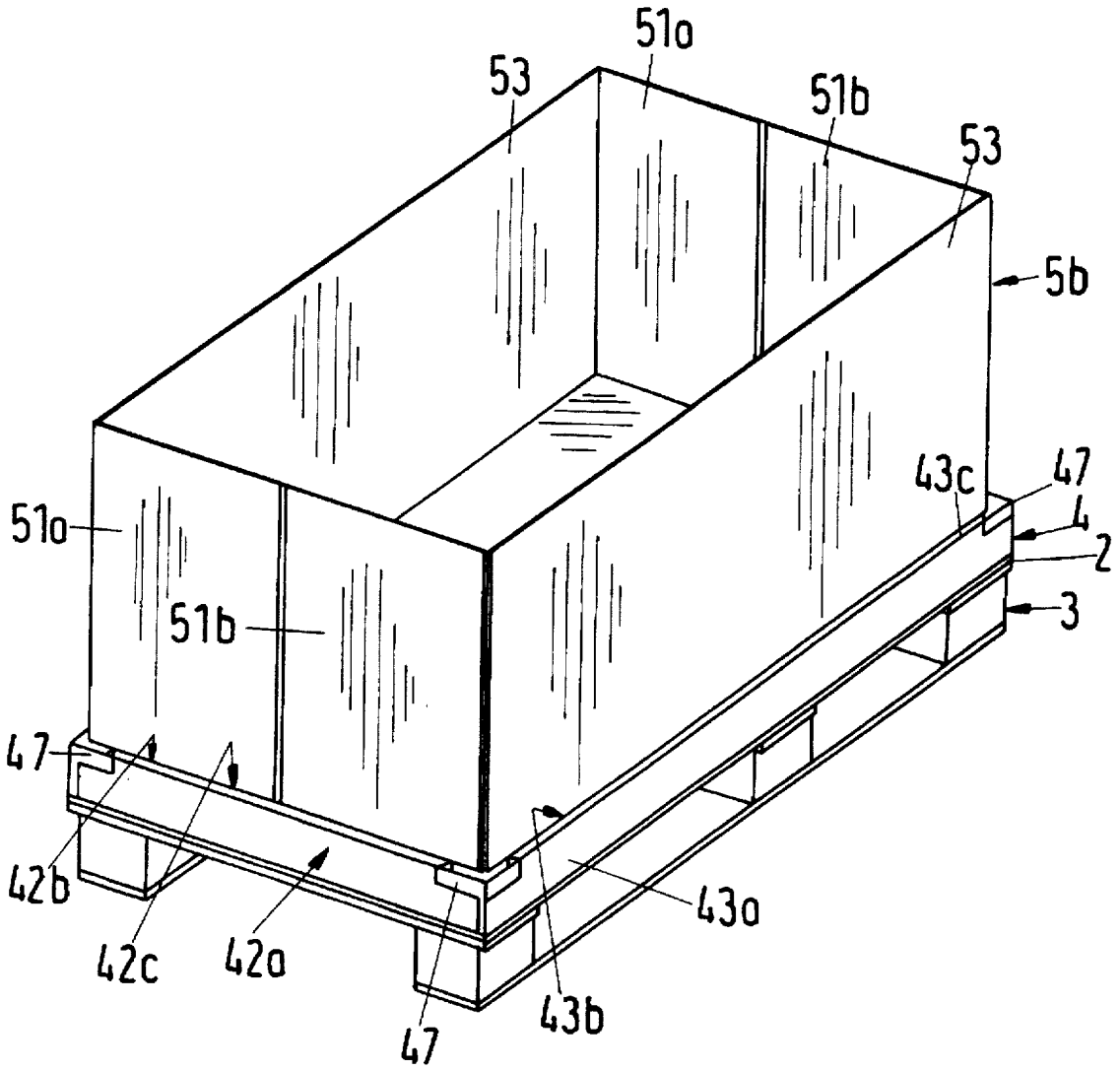
FIG. 20 is a perspective view showing the receptacle of FIG. 18 with the sidewall structure completely unfolded and secured in the bottom frame.

A third representative embodiment of the invention, illustrated in FIGS. 16A–24B, is again very similar to the embodiments previously described. As best seen in FIGS. 18 and 19, the retention elements in this embodiment are in the form of angle fittings 47 located at the corners of the bottom frame 4. Each angle fitting 47 is positioned and screw-fastened from above in a corresponding corner region between an end slat 42 and a side slat 43 of the bottom frame. The angle fitting 47 embraces the end slat 42 and the side slat 43 on their outer surfaces 42*a* and 43*a* and rests also upon the top surfaces 42*c* and 43*c*, so that it acts to additionally stabilize the bottom frame 4. To receive the angle fittings 47, a notch 57 is cut diagonally into the corner region of the end wall 51 and the adjacent side wall 53 so as to match the angle fitting 47. In this embodiment, therefore, the erected sidewall structure 5*b* is retained in position at the corner regions of the sidewall structure. This is shown more clearly in the top view of the angle fitting illustrated in FIG. 21. As there shown, the end slat 42 and the side slat 43 of the bottom frame extend relatively far into the angle fitting 47 so that a large bearing surface is provided.

Figure 21:
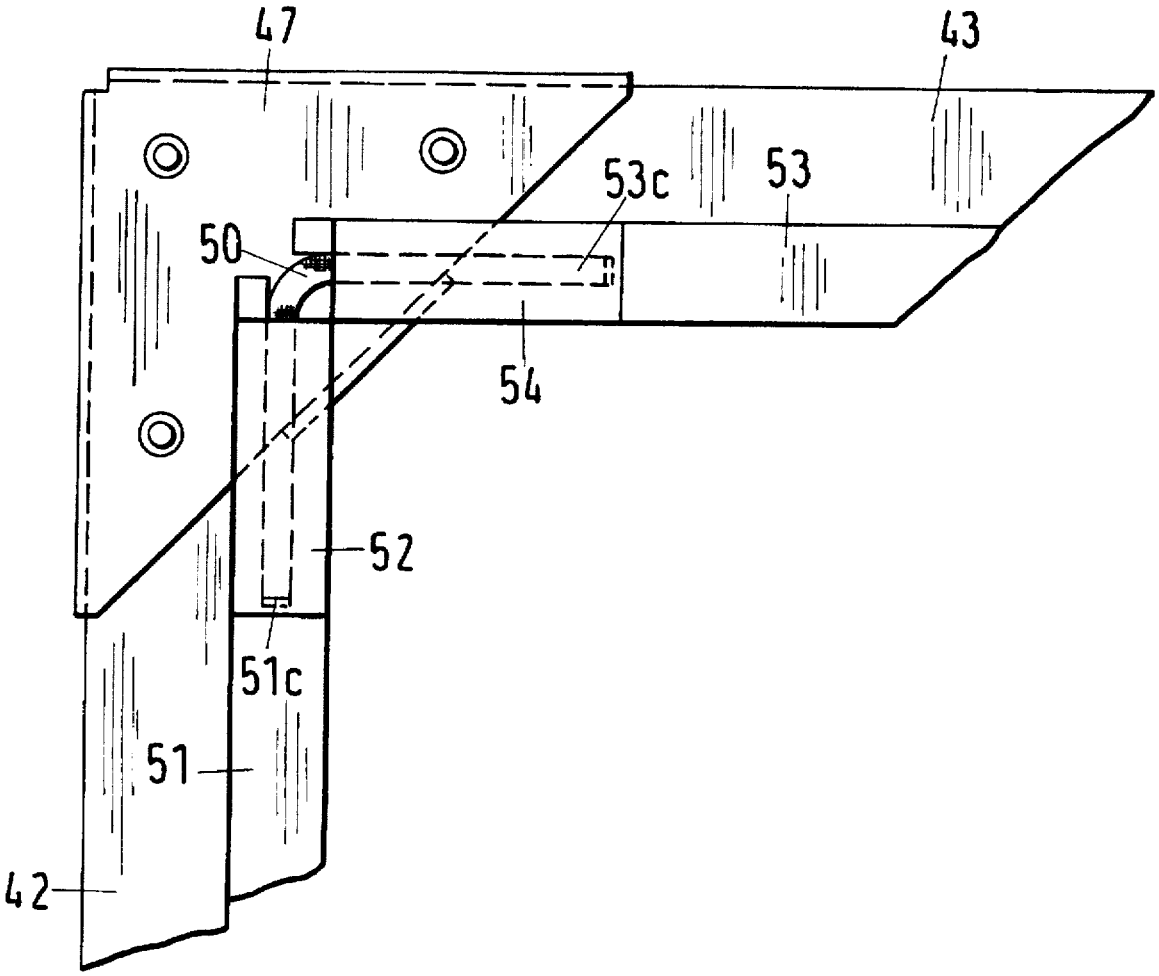
FIG. 21 is an enlarged fragmentary top view showing one corner of the receptacle illustrated in FIG. 20.
Figure 22E:
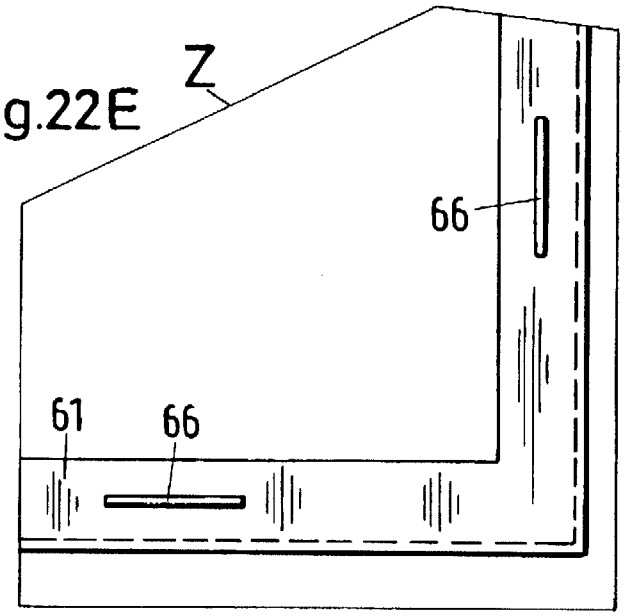
FIG. 22E is an enlarged fragmentary top view showing one corner of the frame of FIG. 22A.
Figure 22D:
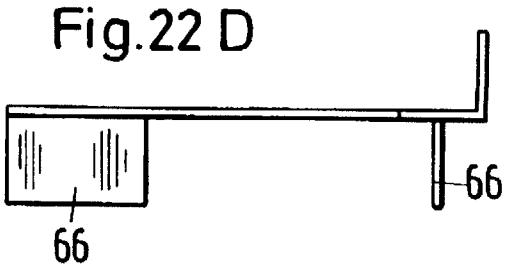
FIG. 22D is an enlarged fragmentary sectional view taken on the line XXII—XXII of FIG. 22A.
Figure 22C:
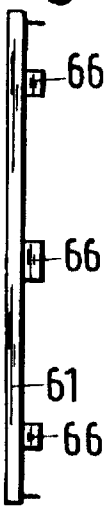
FIGS. 22A, 22B and 22C are bottom, side and end views, respectively, illustrating another form of top frame in accordance with the invention.
Figure 22A:
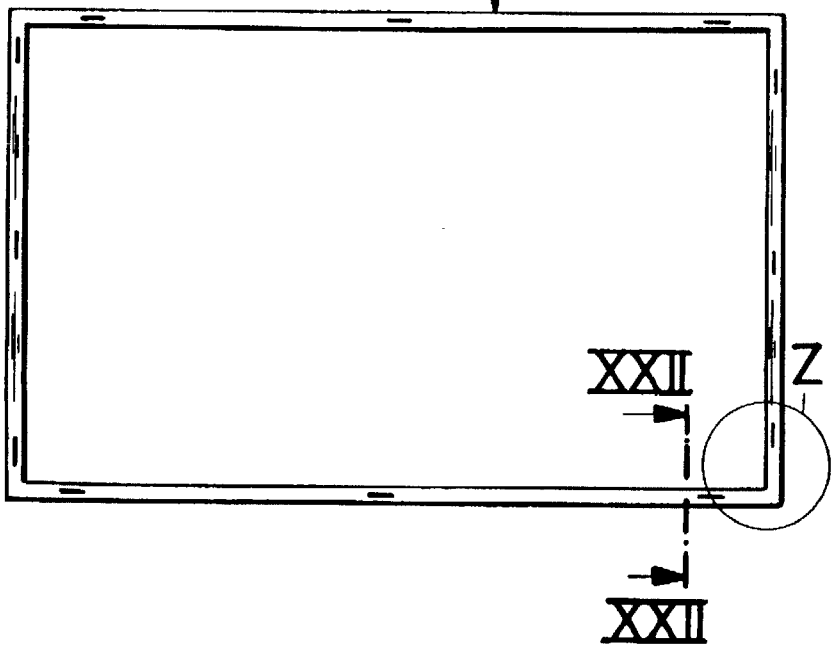
Figure 22B:
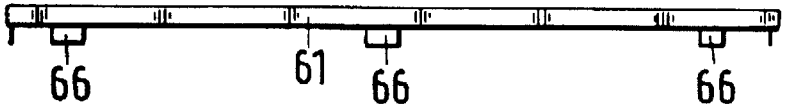
Figure 23:
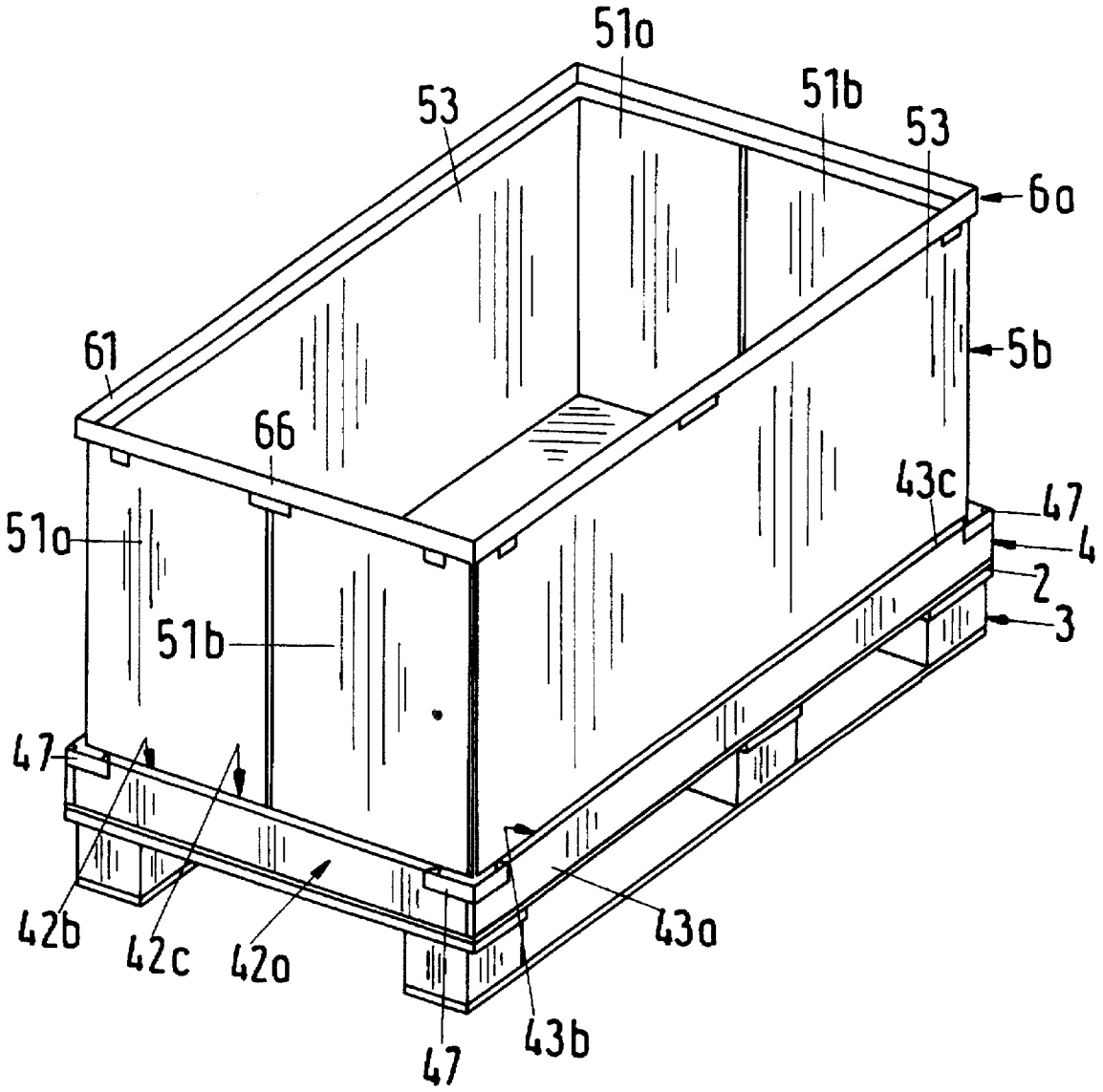
FIG. 23 is a perspective view of the receptacle shown in FIG. 20 with the top frame mounted on the sidewall structure.
Figure 24B:
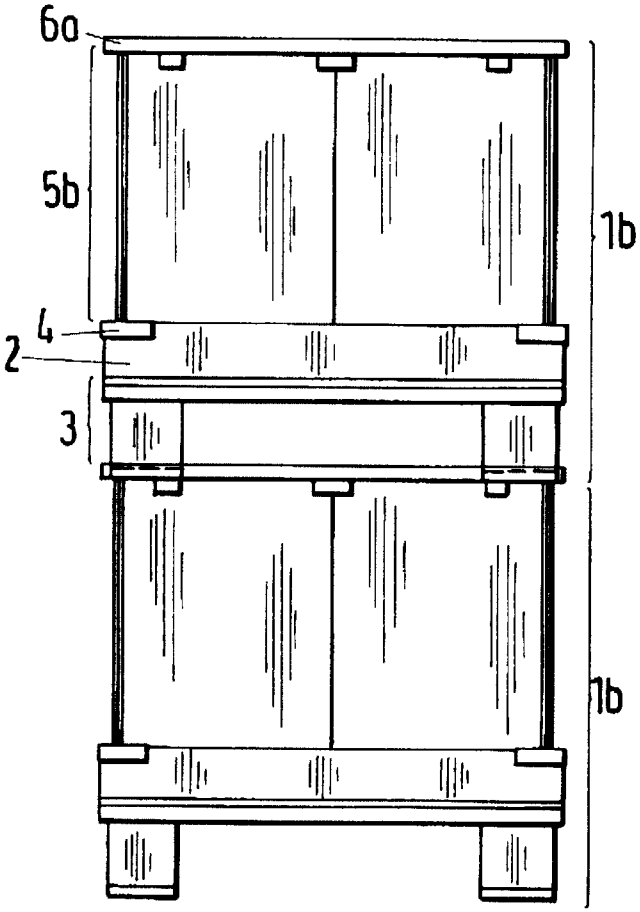
FIGS. 24A and 24B are side and end views, respectively, showing two stacked receptacles with erected sidewall structures of the type shown in FIG. 23.
Figure 24A:
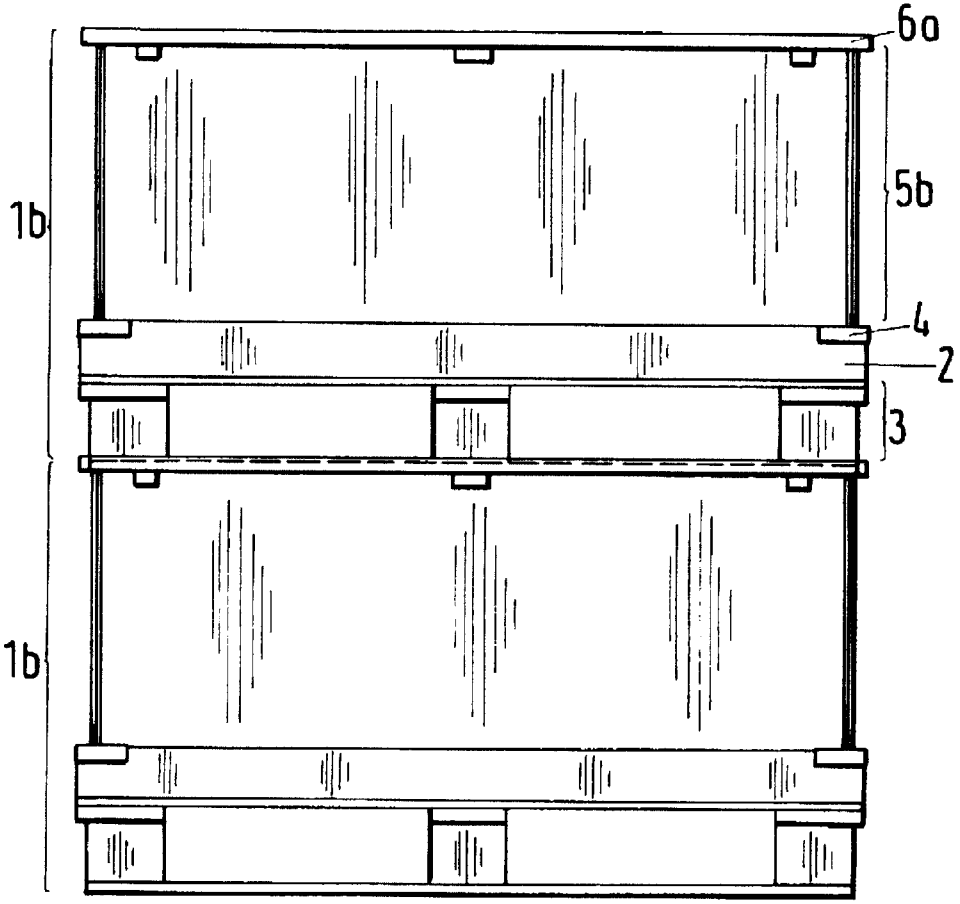

FIG. 21 also illustrates one form of articulated connection extending along a folding edge between an end wall 51 and a side wall 53 of the sidewall structure. In the adjacent edges of the wall members, grooves 51*c* and 53*c* are milled continuously from top to bottom, and a strap 50 is inserted into and fastened in the grooves in any desired manner so that it cannot slip out. The grooves 51*c* and 53*c* have corresponding covers 52 and 54 placed on the top and bottom ends of the walls 51 and 53. This mode of connection is likewise suitable for the other embodiments of the receptacle described above and provides an extremely neat finish in contrast with the conventional nailed wall arrangement.

Another form of top frame 6*a*, different from the previously-described top frame, is shown in FIGS. 22A–22E. In this top frame, which is intended for use with the receptacle of FIGS. 16–21, no corner cleats like the corner cleats 65 previously described are included. Instead, this top frame has only a series of locating cleats 66, three of which are positioned on each of the sides. The omission of corner cleats is necessary because the angle fittings 47 of this embodiment are mounted on the corners of the bottom frame 4, so that these locations cannot be used as cleat supports for the top frame 6 when it is placed on the bottom frame 4.

In all of the above-described embodiments, the top frame 6, depending on the size and loading of the receptacle, may include one, two or three locating cleats 65 along each end wall 51 and/or each side wall 53.

Figure 25:
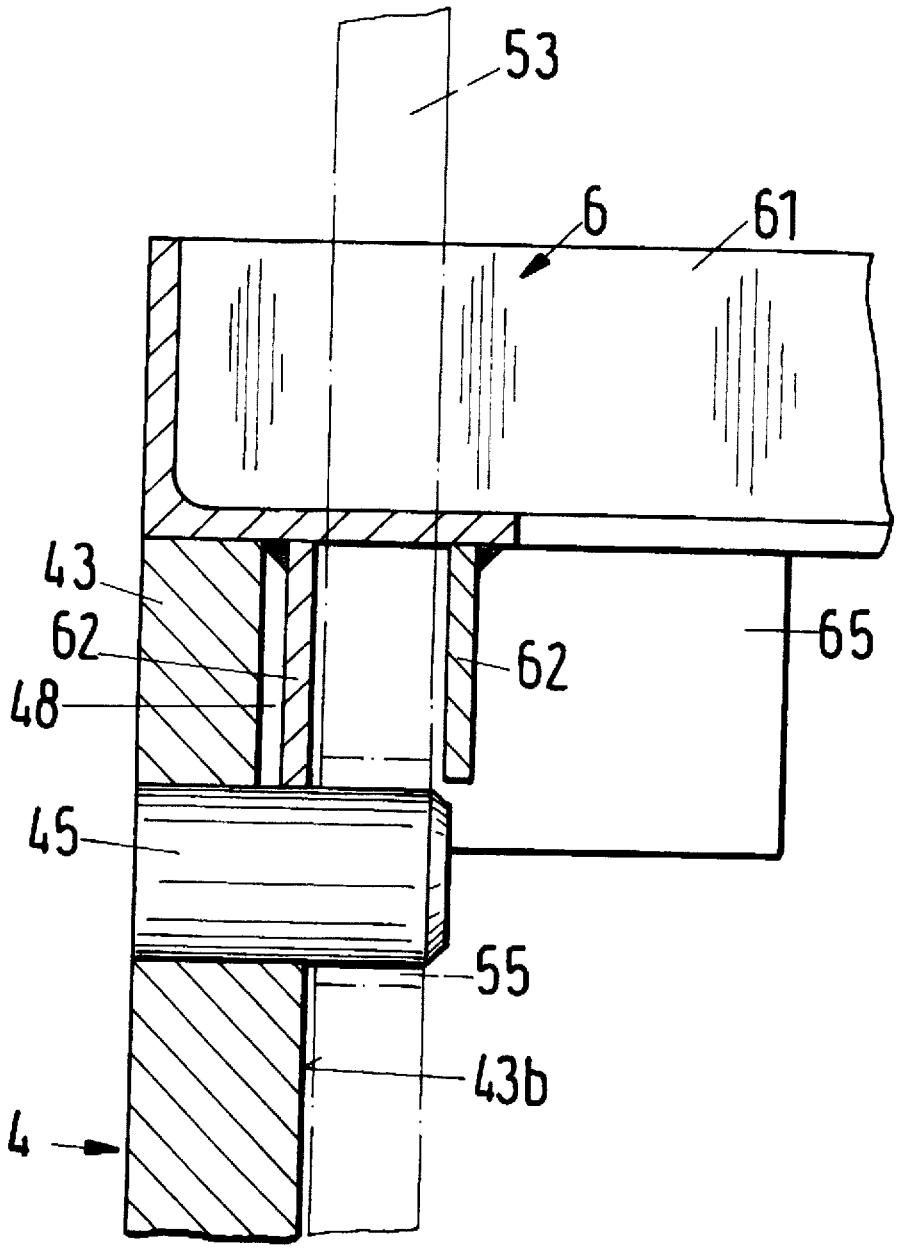
FIG. 25 is an enlarged fragmentary sectional view taken on the line XXV—XXV of FIG. 2, showing a modification of the top frame structure.

FIG. 25 illustrates how the top frame 6 is supported by a molding 61 on the top surface 43 of the bottom frame 4 when the sidewall structure 5 is collapsed. In order to receive the top frame, the inside of the bottom frame 4 includes recesses 48 which are milled out so as to be engaged by the holding clips 62.

A side wall 53 is shown in dot-dash lines in FIG. 25 in the position of the wall when the top frame 6 is taken off and the sidewall structure 5 has been erected with the pin 45 engaged in the opening 55. The top frame 6 may have additional holding clips 62 offset inwardly with respect to the holding clips 62 described above, as shown in FIG. 25, for further stabilization of the receptacle 1 against outward or inward buckling of the end walls 51 and/or side walls 53 when the sidewall structure 5 is erected. These additional holding clips support the sidewall structure 5 from within, thus securely preventing any inward buckling, for example, along a folding edge of the sidewall structure.

Figure 26:
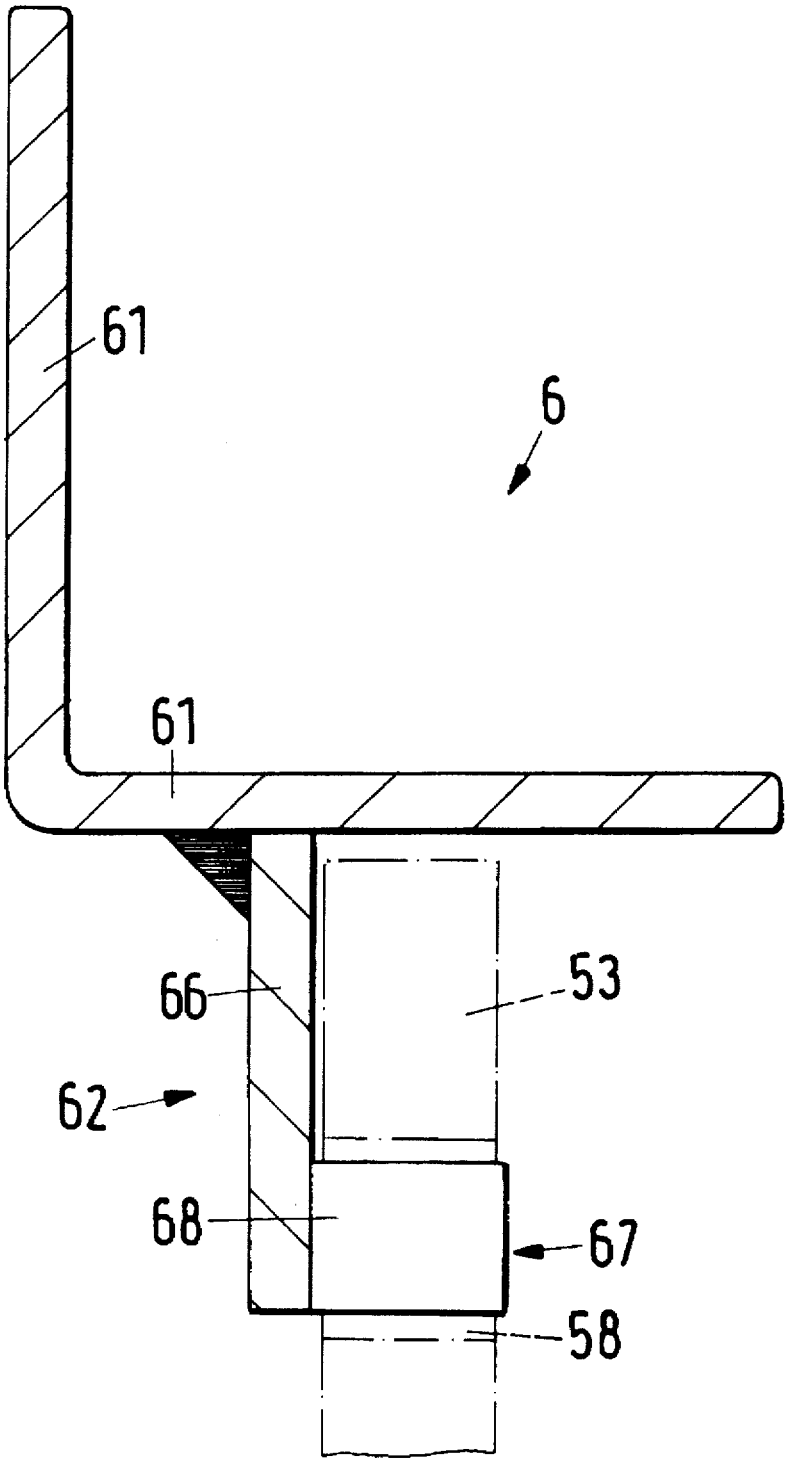
FIG. 26 is an enlarged sectional view taken on the line XXVI—XXVI in FIG. 7A, but showing a modified top frame.

FIG. 26 illustrates a section of the molding 61 of the top frame 6 with a locating cleat 66. The position of a side wall 53 of an erected sidewall structure 5 may be seen in dot-dash lines. For further enhancement of the stability of the receptacle 1, the top frame 6 includes locking elements 67 in the form of locking pins 68 which engage matching locking recesses 58 of the end walls 51 and/or side walls 53 of the erected sidewall structure 5.

Although the invention has been described herein with reference to specific embodiments, many modifications and variations therein will readily occur to those skilled in the art. Accordingly, all such variations and modifications are included within the intended scope of the invention.

We claim:

1. A receptacle comprising a bottom and a sidewall structure erectable on the bottom and capable of being collapsed for storage within the periphery of the bottom, the sidewall structure comprising a plurality of side and end walls articulated to each other so as to be erectable in the shape of a rectangular prism, a bottom frame at the periphery of the bottom having a plurality of retention elements directed inwardly, and a plurality of recesses formed in the sidewall structure at locations corresponding to those of the retention elements in the erected condition of the sidewall structure, the retention elements being removably received when the sidewall structure is erected on the bottom of the receptacle including a top frame having an L-shaped molding with a periphery substantially matching that of the bottom and arranged to receive an additional receptacle, the top frame being arranged to rest on the bottom frame of the receptacle and having depending holding clips which are received within the bottom frame when the sidewall structure is collapsed and which is arranged to be received on the side walls and the end walls of the erected sidewall structure with holding clips disposed on the outside thereof, the top frame also having additional holding clips which are offset to be received on the inside of the side and end walls of an erected sidewall structure.

2. A receptacle according to claim 1 wherein the top frame further includes locking elements to engage locking recesses formed in an erected sidewall structure.

3. A receptacle according to claim 2 wherein the locking elements comprise lock pins projecting inwardly from the holding clips.

4. A receptacle according to claim 1 wherein the bottom frame includes recesses on its inside surface to receive the holding clips when the top frame is positioned on the bottom frame.

5. A receptacle comprising a bottom and a sidewall structure erectable on the bottom and capable of being collapsed for storage within the periphery of the bottom, the sidewall structure comprising a plurality of side and end walls articulated to each other so as to be erectable in the shape of a rectangular prism, a bottom frame at the periphery of the bottom having a plurality of retention elements directed inwardly, and a plurality of recesses formed in the sidewall structure at locations corresponding to those of the retention elements in the erected condition of the sidewall structure, the retention elements being removably received when the sidewall structure is erected on the bottom of the receptacle, and wherein the bottom includes a support structure within its periphery comprising a plurality of support elements positioned adjacent to the periphery of the bottom and a plurality of connecting slats affixed to support elements disposed along two mutually parallel sides of the bottom, wherein the support structure includes further support elements, and wherein the plurality of support elements includes supporting blocks and corner blocks, said connecting slats connect the supporting blocks and corner blocks, said supporting blocks, corner blocks and connecting slats are all positioned flush with the periphery of the bottom, and said further support elements are located beneath the connecting slats and are offset inwardly so as to be recessed within the top of an erected sidewall structure of another receptacle on which the bottom is positioned.

* * * * *

UNITED STATES PATENT AND TRADEMARK OFFICE

CERTIFICATE OF CORRECTION

PATENT NO. : 5,680,948

DATED : October 28, 1997

INVENTOR(S) : Schmidt et al.

It is certified that error appears in the above-identified patent and that said Letters Patent is hereby corrected as shown below:

On the title page:

Item [73] "Assignee: Volkswagen AG, Wolfsburg, Germany" should read --Assignees: Volkswagen AG, Wolfsburg, Germany, and Holzindustrie Fürst zu Fürstenberg KG, Hüfingen, Germany--.

Signed and Sealed this

Twelfth Day of January, 1999

*Attest:*

*Attesting Officer*

*Acting Commissioner of Patents and Trademarks*